US007398632B2

(12) United States Patent
Learn et al.

(10) Patent No.: US 7,398,632 B2
(45) Date of Patent: Jul. 15, 2008

(54) METHODS AND SYSTEMS FOR PACKAGING A PRODUCT

(75) Inventors: Angela E. Learn, Gilbertsville, PA (US); Michael D. Ryan, Drexel Hill, PA (US)

(73) Assignee: Altivity Packaging, LLC, Carol Stream, IL (US)

( * ) Notice: Subject to any disclaimer, the term of this patent is extended or adjusted under 35 U.S.C. 154(b) by 44 days.

(21) Appl. No.: 11/286,912

(22) Filed: Nov. 23, 2005

(65) Prior Publication Data

US 2006/0281617 A1 Dec. 14, 2006

Related U.S. Application Data

(63) Continuation-in-part of application No. 11/151,012, filed on Jun. 13, 2005, now Pat. No. 7,293,652.

(51) Int. Cl.
*B65B 53/02* (2006.01)

(52) U.S. Cl. ..... 53/442; 53/441; 53/399; 53/411; 53/381.1; 53/526; 53/528; 206/497

(58) Field of Classification Search ..... 53/441, 53/442, 399, 397, 411, 381.1, 580, 582, 589, 53/376.6, 377.7, 526–528; 206/497
See application file for complete search history.

(56) References Cited

U.S. PATENT DOCUMENTS 3,369,660 A 2/1968 Hartman
3,589,091 A 6/1971 Cloud
3,752,312 A 8/1973 Soltanoff
3,982,712 A 9/1976 Bassett
4,381,058 A * 4/1983 Chaussadas et al. ..... 206/497
4,395,863 A * 8/1983 Chaussadas et al. ..... 53/442
4,586,312 A 5/1986 Limousin
4,756,415 A 7/1988 Call
4,871,345 A 10/1989 Wosaba, II et al.
4,947,605 A 8/1990 Ramsey
4,972,953 A 11/1990 Friedman et al.
5,201,463 A 4/1993 George
5,507,429 A * 4/1996 Arlin ..... 229/102

(Continued)

OTHER PUBLICATIONS

International Search Report dated Sep. 26, 2006, Application No. PCT/US06/16828, 3 pages.

(Continued)

*Primary Examiner*—Christopher Harmon
(74) *Attorney, Agent, or Firm*—Womble Carlyle Sandridge & Rice, PLLC

(57) ABSTRACT

A method for applying a heat shrinkable film to a carton for forming a shape of the carton is provided. The carton includes a top panel, a bottom panel, at least one side panel extending between the top panel and the bottom panel, and a movable section that is movable between a first position and a second position. The method includes providing a heat-shrinkable but unshrunken film, wrapping the film in an unheated condition around at least a portion of the carton including at least a portion of the movable section of the carton, and moving the movable section from the first position to the second position to form a shape of the carton by heating the heat-shrinkable film to shrink the heat-shrinkable film into contact with at least a portion of the movable section.

20 Claims, 19 Drawing Sheets

U.S. PATENT DOCUMENTS

| | | | | |
|---|---|---|---|---|
| 5,572,951 | A | 11/1996 | Evans et al. | |
| 5,590,779 | A | 1/1997 | Ramsey | |
| 5,771,662 | A | 6/1998 | Struges et al. | |
| 5,992,630 | A | 11/1999 | Brown et al. | |
| 6,020,823 | A | 2/2000 | DeCicco | |
| 6,024,224 | A | 2/2000 | Gnadt et al. | |
| 6,173,833 | B1 | 1/2001 | Strehlow | |
| 6,247,612 | B1 | 6/2001 | Kaufman | |
| 6,267,258 | B1 | 7/2001 | Wilkerson et al. | |
| 6,340,532 | B1 * | 1/2002 | Huang et al. | 428/523 |
| 6,405,869 | B1 | 6/2002 | Whittemore et al. | |
| 6,435,561 | B1 | 8/2002 | Verenski | |
| 6,505,737 | B1 | 1/2003 | Sherman | |
| 6,554,448 | B2 | 4/2003 | Carpenter et al. | |
| 6,571,953 | B2 | 6/2003 | Sherline et al. | |
| 6,783,005 | B2 | 8/2004 | Giblin et al. | |
| 2002/0073661 | A1 | 6/2002 | Nolan | |
| 2006/0144742 | A1 | 7/2006 | Ours | |

OTHER PUBLICATIONS

International Search Report dated Aug. 31, 2006, Application No. PCT/US06/17021, 6 pages.

* cited by examiner

METHODS AND SYSTEMS FOR PACKAGING A PRODUCT

CROSS REFERENCE TO RELATED APPLICATIONS

This application is a continuation-in-part of U.S. patent application Ser. No. 11/151,012, filed Jun. 13, 2005 now U.S. Pat. No. 7,293,652, entitled "Methods and Systems for Packaging a Product," which is incorporated by reference herein in its entirety.

BACKGROUND OF THE INVENTION

The methods and apparatus described herein relate generally to packaging, and more specifically to cartons for packaging a product.

At least some known cartons used for packaging a product include markings, indicia, and/or a shape that communicates the product, a manufacturer of the product, and/or a seller of the product to consumers. For example, such cartons may include printed text that indicates a product's name and briefly describes the product, logos and trademarks that indicate a manufacturer and/or seller of the product, and/or designs that attract a consumer's attention. Other cartons, for example, may have a shape that corresponds to a product packaged within the carton and/or a shape that indicates a manufacture and/or seller of the product. Still further, and for example, some known cartons may include a shape that provides functionality, such as a shape that promotes the display of the carton, a shape that facilitates stacking and/or arrangement of a plurality of cartons, and/or a shape that facilitates carrying the carton. However, cartons having shapes that are more complex than conventional rectangular cartons may be difficult and costly to manufacture. Additionally, such cartons may be less likely to maintain their shape during transport and/or display thereof.

Some known cartons that package a product are also sealed to protect the product from tampering and to generally seal the joints of the carton for containing the product within the carton as well as protecting the product from contamination. For example, some known cartons include a band around a joint between portions of the carton, such as a lid and a base, to seal the carton. Other known cartons may include a bag or a liner that is sealed within the interior cavity of the carton for storing the product in a sealed environment. Moreover, there are at least some other known cartons, for example, that completely wrap the carton in shrink-wrap that is thereafter heated to shrink it tightly around the carton. However, when a carton is completely sealed with shrink-wrap portions of the carton may not be accessible without breaking the seal, thereby possibly making display and/or transport of the carton more difficult.

BRIEF DESCRIPTION OF THE INVENTION

In one aspect, a method for applying a heat shrinkable film to a carton for forming a shape of the carton is provided. The carton includes a top panel, a bottom panel, at least one side panel extending between the top panel and the bottom panel, and a movable section that is movable between a first position and a second position. The method includes providing a heat-shrinkable but unshrunken film, wrapping the film in an unheated condition around at least a portion of the carton including at least a portion of the movable section of the carton, and moving the movable section from the first position to the second position to form a shape of the carton by heating the heat-shrinkable film to shrink the heat-shrinkable film into contact with at least a portion of the movable section.

In another aspect, a system for applying a heat shrinkable film to a carton for forming a shape of the carton is provided. The system includes a carton having a top panel, a bottom panel, at least one side panel extending between the top panel and the bottom panel, and a movable section that is movable between a first position and a second position. The system further includes a wrapping device configured to wrap a heat-shrinkable but unshrunken film in an unheated condition around at least a portion of the carton including at least a portion of the movable section of the carton, and a heating device configured to heat at least a portion of the heat-shrinkable film into contact with at least a portion of the movable section to move the movable section from the first position to the second position to form a shape of the carton.

BRIEF DESCRIPTION OF THE DRAWINGS

Corresponding reference characters indicate corresponding parts throughout the several views of the drawings.

DETAILED DESCRIPTION OF THE INVENTION

Figure 1:
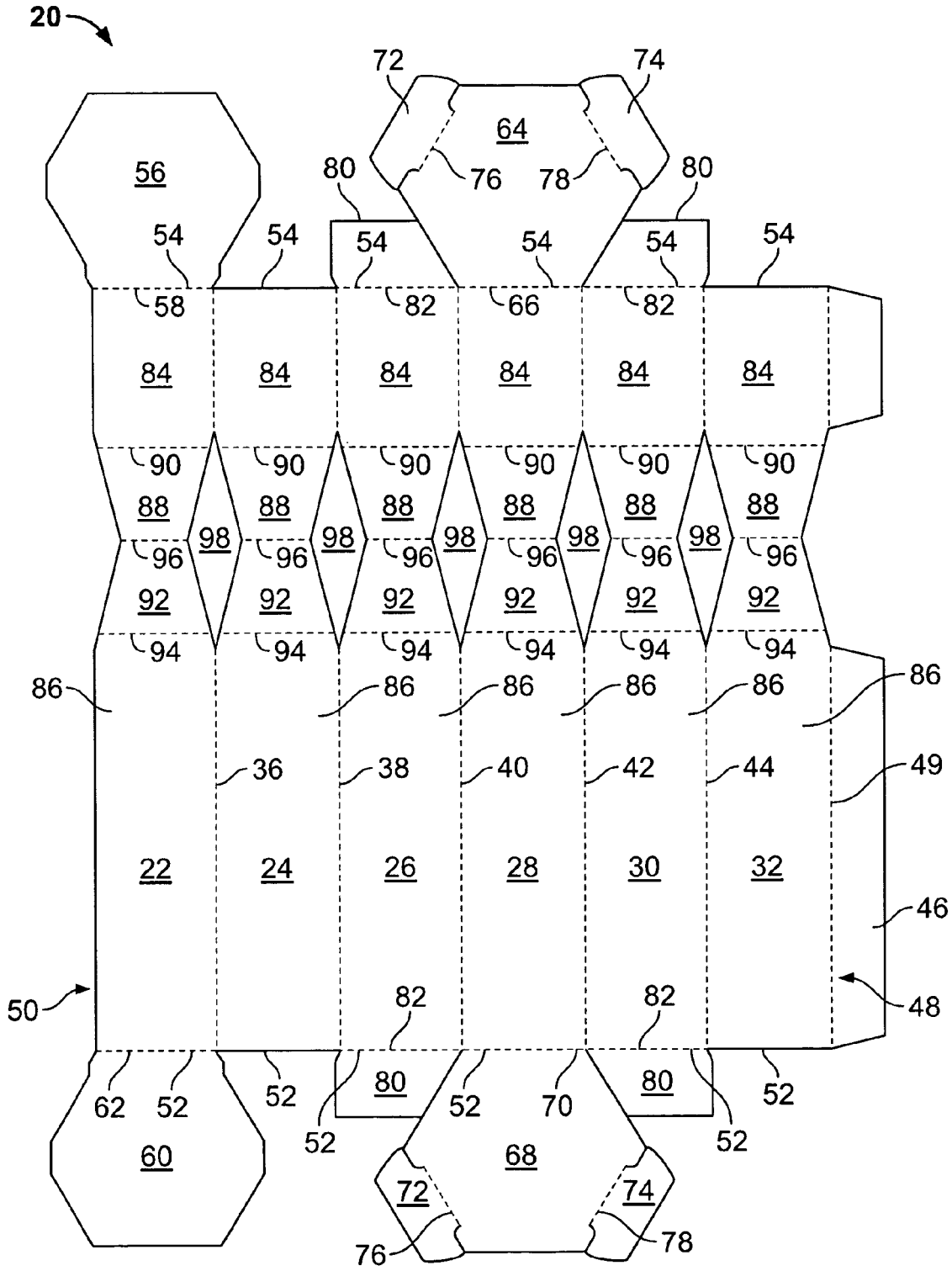
FIG. 1 is a top plan view of an exemplary embodiment of a blank of sheet material for forming an exemplary carton.

Generally, packaging assemblies are described herein that may be formed from a carton having a heat-shrunk layer (sometimes referred to as, for example, "shrink-wrap") overlapping a portion thereof. In the exemplary embodiment, the carton is made from a paperboard material. The carton, however, could be made from other materials, and therefore is not limited to a specific type of material. In some embodiments, a packaging assembly may include a movable section that is movable from a first position to a second position to form a shape of the package assembly. The movable section may be moved by, for example, wrapping a heat-shrinkable layer around at least a portion of the movable section such that the layer overlaps at least a portion of the movable section, and heating the heat-shrinkable layer to shrink the heat-shrinkable layer into contact with at least a portion of the movable section to move the movable section from the first position to the second position as the layer shrinks under the heat. The movable section may be any portion of the carton and may be movable in any suitable motion and/or direction, whether such portion, motion, and/or direction is described and/or illustrated herein.

In some embodiments, a carton and/or a heat-shrinkable/shrunk layer may include a marking thereon, such as, but not limited to, indicia that communicates the product, a manufacturer of the product, and/or a seller of the product. For example, printed text that indicates a product's name and briefly describes the product, logos and/or trademarks that indicate a manufacturer and/or seller of the product, and/or designs and/or ornamentation that attract attention. Moreover, in some embodiments a package assembly may include a handle for carrying the assembly.

The cartons, heat-shrinkable/shrunk layers, and packaging assemblies generally may each have any suitable size, shape, and/or configuration (e.g., number of sides), whether such sizes, shapes, and/or configurations are described and/or illustrated herein. For example, in one embodiment a package assembly includes a shape that corresponds to a product packaged within the carton and/or a shape that indicates a manufacture and/or seller of the product. Moreover, and for example, in one embodiment a package assembly includes a shape that provides functionality, such as a shape that promotes the display of the carton, a shape that facilitates stacking and/or arrangement of a plurality of cartons, and/or a shape that facilitates carrying the carton. Similarly, the cartons, heat-shrinkable/shrunk layers, and packaging assemblies generally may be formed from any suitable material, whether such materials are described herein. For example, in one embodiment a carton includes cardboard, corrugated board, and/or plastic. Additionally, in one embodiment a heat-shrinkable/shrunk layer includes polyethylene, polypropylene, polyvinyl chloride, polyester glycol, nylon, and/or oriented polystyrene. Although other types of heat-shrinkable/shrunk layers may be used, in one embodiment a heat-shrinkable/shrunk layer is a sheet of material or a sleeve of material.

Figure 2:
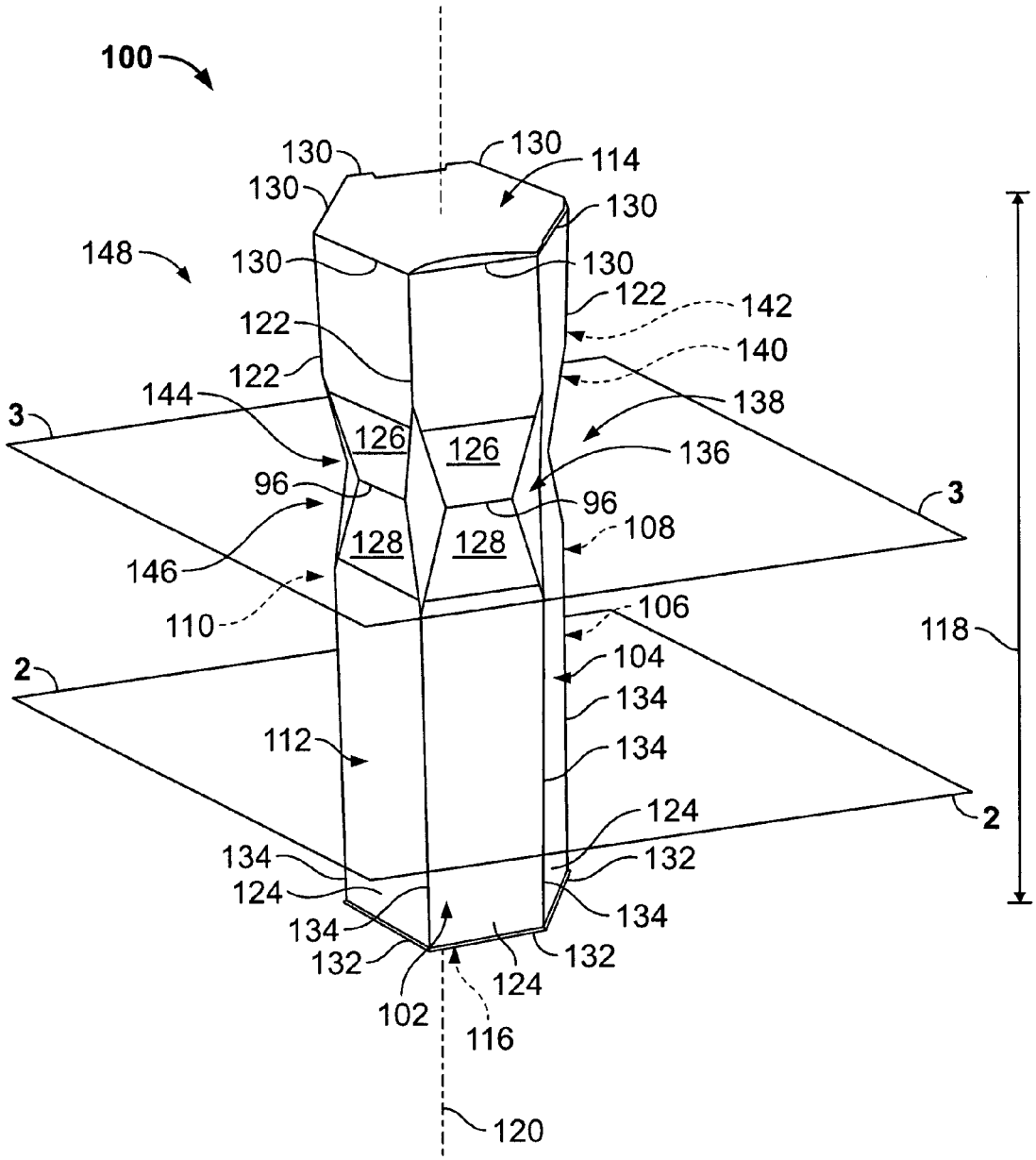
FIG. 2 is a perspective view of an exemplary embodiment of a carton formed from the blank shown in FIG. 1.
Figure 3:
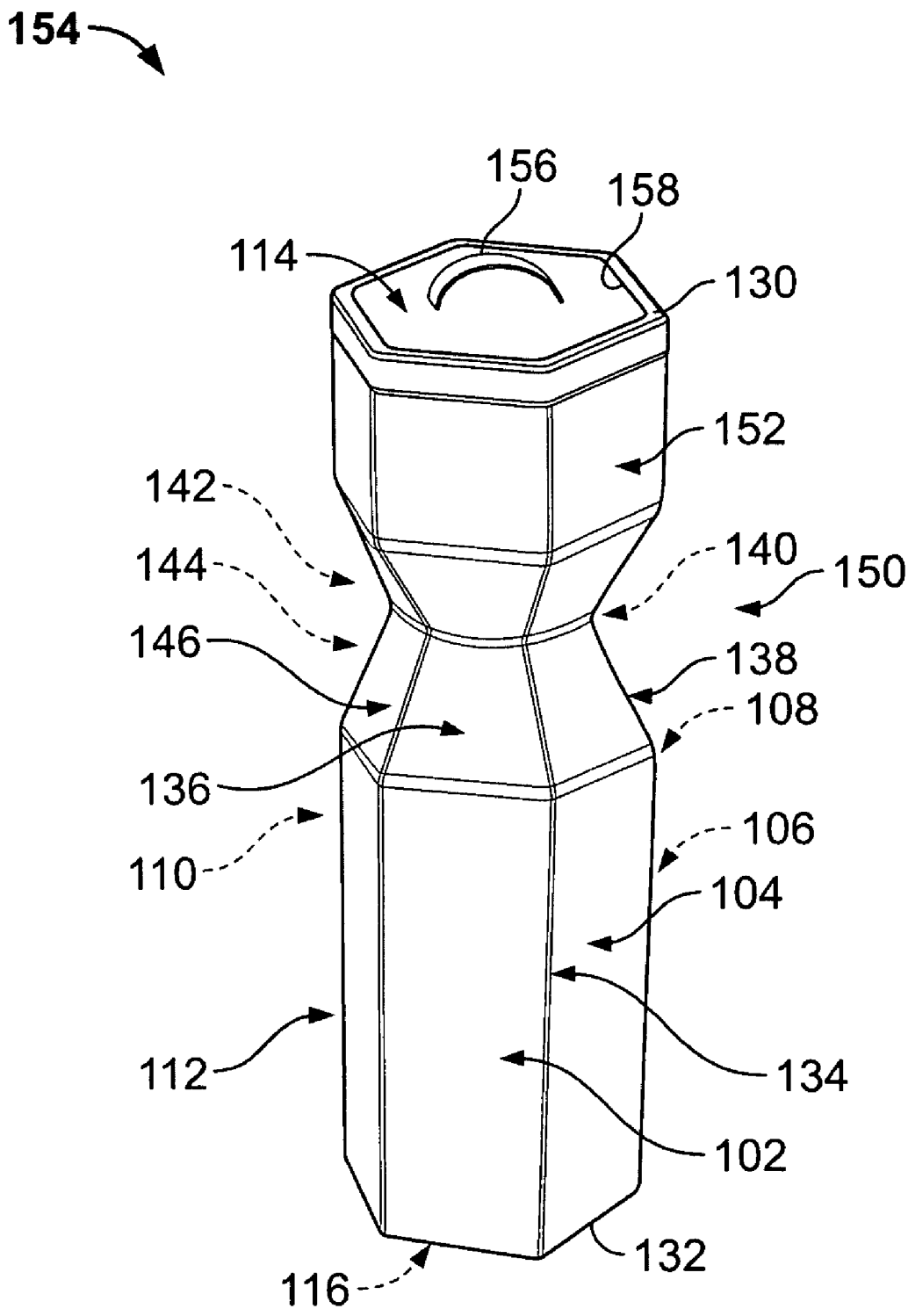
FIG. 3 is a perspective view of an exemplary embodiment of a packaging assembly including the carton shown in FIG. 2.

Referring now to the drawings, and more specifically to FIGS. 1-3, although as described above a package assembly may have any suitable size, shape, and/or configuration (e.g., number of sides), FIGS. 1-3 illustrate the formation of one embodiment of a package assembly. Specifically, FIG. 1 is a top plan view of one embodiment of a blank of sheet material (designated in its entirety by the reference numeral 20). FIG. 2 is a perspective view of one embodiment of a carton (designated in its entirety by 100) formed from the blank 20 shown in FIG. 1. FIG. 3 is a perspective view of one embodiment of a packaging assembly (designated in its entirety by 154) including the carton 100 shown in FIG. 2.

Referring to FIG. 1, the blank 20 includes a succession of six side panels 22, 24, 26, 28, 30, and 32 that are connected together by a plurality of preformed, generally parallel, fold lines 36, 38, 40, 42, and 44, respectively. Specifically, each of the side panels 22, 24, 26, 28, 30, and 32 extends from an adjacent one of the side panels along the respective fold lines 36, 38, 40, 42, and 44. A side panel flap 46 extends from an end portion (generally designated by 48) of the side panel 32, or alternatively from an end portion (generally designated by 50) of the side panel 22, along a fold line 49 for facilitating securing the end portions 48 and 50 together to form the carton 100 (shown in FIG. 2). Each of the side panels 22, 24, 26, 28, 30, and 32 extends a height measured between a bottom end 52 and a top end 54. The side panel 22 (or alternatively any of the other side panels 24, 26, 28, 30, and 32) includes a top support panel 56 extending from the top end 54 thereof along a fold line 58 and a bottom support panel 60 extending from the bottom end 52 thereof along a fold line 62. Additionally, the side panel 28 (or alternatively any other of the side panels 22, 24, 26, 30, and/or 32) includes a top panel 64 extending from the top end 54 thereof along a fold line 66 and a bottom panel 68 extending from the bottom end 52 thereof along a fold line 70. The top panel 64 and the bottom panel 68 each include two securement tabs 72 and 74 extending therefrom along respective fold lines 76 and 78 for facilitating securing the top panel 64 and the bottom panel 68 to the side panels 22, 24, 26, 28, 30, and 32 to form a top 114 (shown in FIG. 2) and a bottom 116 (shown in FIG. 2) of the carton 100. Moreover, the top ends 54 and the bottom ends 52 of each of the side panels 26 and 30 include a securement flap 80 extending therefrom along a fold line 82 for mating with the securement tabs 72 and 74 to form the carton 100. Of course, the top panel 64 and the bottom panel 68 may include any suitable interconnection means in addition to, or alternatively to, the tab 72, 74/flap 80 arrangement described above. Accordingly, the top, bottom, and side panels 64, 68, 26, and 30, respectively, are not limited to interconnection using a tab/flap arrangement. For example, in one embodiment, adhesive is applied to portions of the top, bottom, and/or side panels 64, 68, 26, and 30, respectively.

The side panels 22, 24, 26, 28, 30, and 32 each include an upper panel portion 84 and a lower panel portion 86. The upper panel portions 84 each include an upper panel extension 88 extending therefrom along a fold line 90, and the lower panel portions 86 each include a lower panel extension 92 extending therefrom along a fold line 94. The upper panel extensions 88 are each joined to a corresponding lower panel extension 92 along a central fold line 96. As can be seen in FIG. 1, an opening 98 is defined between adjacent pairs of joined upper and lower panel extensions 88 and 92 to accommodate changing a cross-sectional area of the carton 100 as will be described below.

As shown in FIG. 2, a carton 100 can be formed from the blank 20 (shown in FIG. 1) by folding the blank about the various fold lines 36, 38, 40, 42, 44, 49, 58, 62, 66, 70, 76, 78, and 82 (shown in FIG. 1). In one embodiment, an adhesive may be applied to portions of the blank 20 to secure the carton 100 together. Generally, the side panels 22, 24, 26, 28, 30, and 32 (shown in FIG. 1) form six successive sides (generally designated by 102, 104, 106, 108, 110, and 112) of the carton 100, the top panel 64 (shown in FIG. 1) forms a top (generally designated by 114) of the carton 100, and the bottom panel 68 (shown in FIG. 1) forms a bottom (generally designated by 116) of the carton 100. The carton 100 extends a height 118 measured between the top 114 and the bottom 116 of the carton 100 along a central longitudinal axis 120 extending through the carton 100. As can be seen in FIG. 2, in one embodiment, the carton 100 includes a generally hexagonal cross-sectional shape, for example, a cross section taken along the plane 2-2 extending generally perpendicularly to the central longitudinal axis 120. As can also be seen in FIG. 2, each of the sides 102, 104, 106, 108, 110, and 112 extends between the top 114 and the bottom 116 of the carton 100. More specifically, in one embodiment, each of the sides 102, 104, 106, 108, 110, and 112 extends from the top 114 to the bottom 116. Any of the sides 102, 104, 106, 108, 110, and 112 may be referred to herein as a first, a second, a third, a fourth, a fifth, and/or a sixth side.

The upper panel portions 84 and the lower panel portions 86 (shown in FIG. 1) form upper portions 122 and lower portions 124, respectively, of each of the sides 102, 104, 106, 108, 110, and 112. The upper panel extensions 88 and the lower panel extensions 92 form upper extensions 126 and lower extensions 128, respectively, of each of the sides 102, 104, 106, 108, 110, and 112. A corner 130 is defined at an intersection between the top 114 and each of the sides 102, 104, 106, 108, 110, and 112. Similarly, a corner 132 is defined at an intersection between the bottom 116 and each of the sides 102, 104, 106, 108, 110, and 112. Moreover, a corner 134 is defined at an intersection between each adjacent side of the sides 102, 104, 106, 108, 110, and 112.

The upper and lower extensions 126 and 128 each form a movable section (generally designated by 136, 138, 140, 142, 144, and 146) of the carton 100. As can be seen in FIG. 2, in one embodiment, each of the movable sections 136, 138, 140, 142, 144, and 146 are located along the central longitudinal axis 120 at a generally equal distance from the top 114. More specifically, each of the central fold lines 96 is located along the central longitudinal axis 120 at a generally equal distance from the top 114. Any of the movable sections 136, 138, 140, 142, 144, and 146 may be referred to herein as a first, a second, a third, a fourth, a fifth, and/or a sixth movable section.

The movable sections 136, 138, 140, 142, 144, and 146 are each movable between a first position shown in FIG. 2 (and generally designated by 148) and a second position shown in FIG. 3 (and generally designated by 150). In one embodiment, the movable sections 136, 138, 140, 142, 144, and 146 are movable from the first position 148 to the second position 150 by bending the upper and lower extensions 126 and 128 along the fold lines 90, the fold lines 94, and the central fold lines 96 to generally radially move the central fold lines 96 with respect to the central longitudinal axis 120 of the carton 100. Accordingly, and as can be seen in FIGS. 2 and 3, movement between the first and second positions 148 and 150, respectively, varies, or changes, a cross-sectional width of the carton 100 defined between two opposite sides of the sides 102, 104, 106, 108, 110, and 112 along the height of the carton 100. In one embodiment, a cross-sectional width defined between two opposite sides of the sides 102, 104, 106, 108, 110, and 112 and taken through the movable sections 136, 138, 140, 142, 144, and 146 (e.g., a cross section taken alone plane 3-3 in FIG. 2) is generally greater in the first position 148 than in the second position 150. More specifically, as can be seen in FIGS. 2 and 3, each of the central fold lines 96 is spaced a greater radial distance from the central longitudinal axis 120 in the first position 148 than in the second position 150. In one embodiment, at least one of the movable sections 136, 138, 140, 142, 144, and 146 is biased in the first position 148. Although the movable sections 136, 138, 140, 142, 144, and/or 146 may be biased in the first position 148 using any suitable mechanism, in one embodiment, a structure of the carton 100 biases the movable sections 136, 138, 140, 142, 144, and/or 146.

Once the carton 100 has been formed, and either before, simultaneously with, or after a product is placed within the carton 100, a heat-shrinkable layer (generally designated by 152) can be wrapped around at least a portion of the carton 100 and heat-shrunk to form a package assembly, one embodiment of which is shown in FIG. 3 and generally designated by 154. Specifically, in the embodiment shown in FIG. 3 the heat-shrinkable layer 152 is wrapped around the sides 102, 104, 106, 108, 110, and 112, a portion of which extends beyond the top 114 and another portion of which extends beyond the bottom 116. The layer 152 is then heated to shrink the heat-shrinkable layer into contact with the carton 100. The layer 152 shrinks to fit snuggly around the carton 100. Although the heat-shrinkable layer 152 can overlap any portion of the carton 100, in the embodiment shown in FIG. 3 the heat-shrunk layer 152 substantially overlaps the sides 102, 104, 106, 108, 110, and 112 and the corners 130, 132, and 134, and overlaps a portion of the top 114 and at least a portion of the bottom 116. Although other types of heat-shrinkable layers may be used, in one embodiment the heat-shrinkable layer 152 is a sheet of material or a sleeve of material. Additionally, although other materials may be used for the layer 152, in one embodiment the layer 152 includes polyethylene, polypropylene, polyvinyl chloride, polyester, polyester glycol, nylon and/or oriented polystyrene.

The heat-shrunk layer 152 may facilitate sealing the carton 100 to protect a product contained within the carton from tampering and to generally seal the corners/joints of the carton 100 for containing the product within the carton 100 as well as protecting the product from contamination. The heat-shrunk layer 152 can be used, for example, to replace bags or liners sometimes used within a container for sealing a product. The tight fit of the heat-shrunk layer 152 may also facilitate maintaining a shape of the carton 100 for example, to facilitate displaying, stacking and/or arranging the carton 100 or a plurality thereof of cartons, and/or maintaining a shape that facilitates other functionality such as carrying the carton.

In one embodiment, the top 114 (and/or one or more of the sides 102, 104, 106, 108, 110, and 112) includes a handle 156 extending outwardly therefrom for carrying the assembly. The heat-shrunk layer 152 includes an opening 158 therein adjacent the handle 156 such that the handle 156 extends through the opening 158 allowing access to the handle when the heat-shrunk layer 152 overlaps a portion of the carton 100.

In one embodiment, the carton 100 and/or the layer 152 includes a marking thereon, such as, but not limited to, indicia that communicates the product, a manufacturer of the product, and/or a seller of the product. For example, printed text that indicates a product's name and briefly describes the product, logos and trademarks that indicate a manufacturer and/or seller of the product, and/or designs and/or ornamentation that attracts attention.

The heat-shrinkable layer 152 may also facilitate forming of the carton, and more specifically moving the moveable sections 136, 138, 140, 142, 144, and 146 from the first position 148 to the second position 150 to form the package assembly 154. As described above, cartons having shapes that are more complex than conventional rectangular cartons may be difficult and therefore costly to manufacture.

However, in one embodiment the heat-shrinkable layer 152 is wrapped around the carton 100 such that the heat-shrinkable layer 152 overlaps at least a portion of one or more of the movable sections 136, 138, 140, 142, 144, and 146. As the layer 152 is heated and shrinks into contact with the movable sections 136, 138, 140, 142, 144, and 146, the layer moves the movable sections 136, 138, 140, 142, 144, and 146 from the first position 148 (shown in FIG. 2) to the second position 150 to form a shape of the package assembly 154. The heat-shrunk layer 152 then holds the movable sections 136, 138, 140, 142, 144, and 146 in the second position 150 as long as the layer 152 remains substantially wrapped around the carton 100. In one embodiment wherein the movable sections 136, 138, 140, 142, 144, and 146 are biased to the first position 148, the layer 152 moves the movable sections to, and holds the movable section in, the second position 150 against the bias. By moving and holding the movable sections 136, 138, 140, 142, 144, and 146 into the second position 150, the layer 152 facilitates forming a shape of the package assembly 154, and more specifically the carton 100, that may be otherwise difficult and costly to form.

Figure 4:
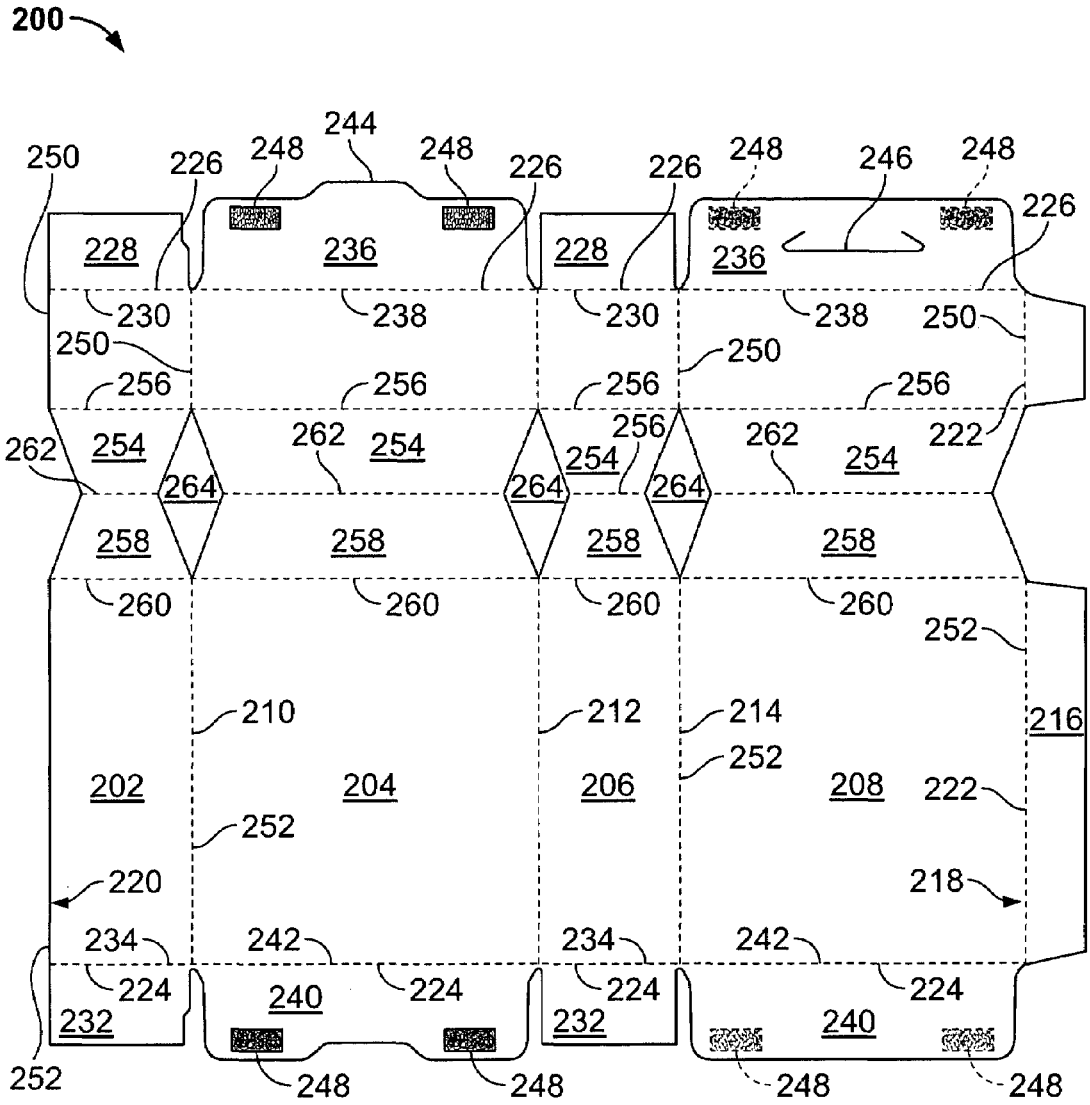
FIG. 4 is a top plan view of an exemplary embodiment of a blank of sheet material for forming another exemplary carton.
Figure 5:
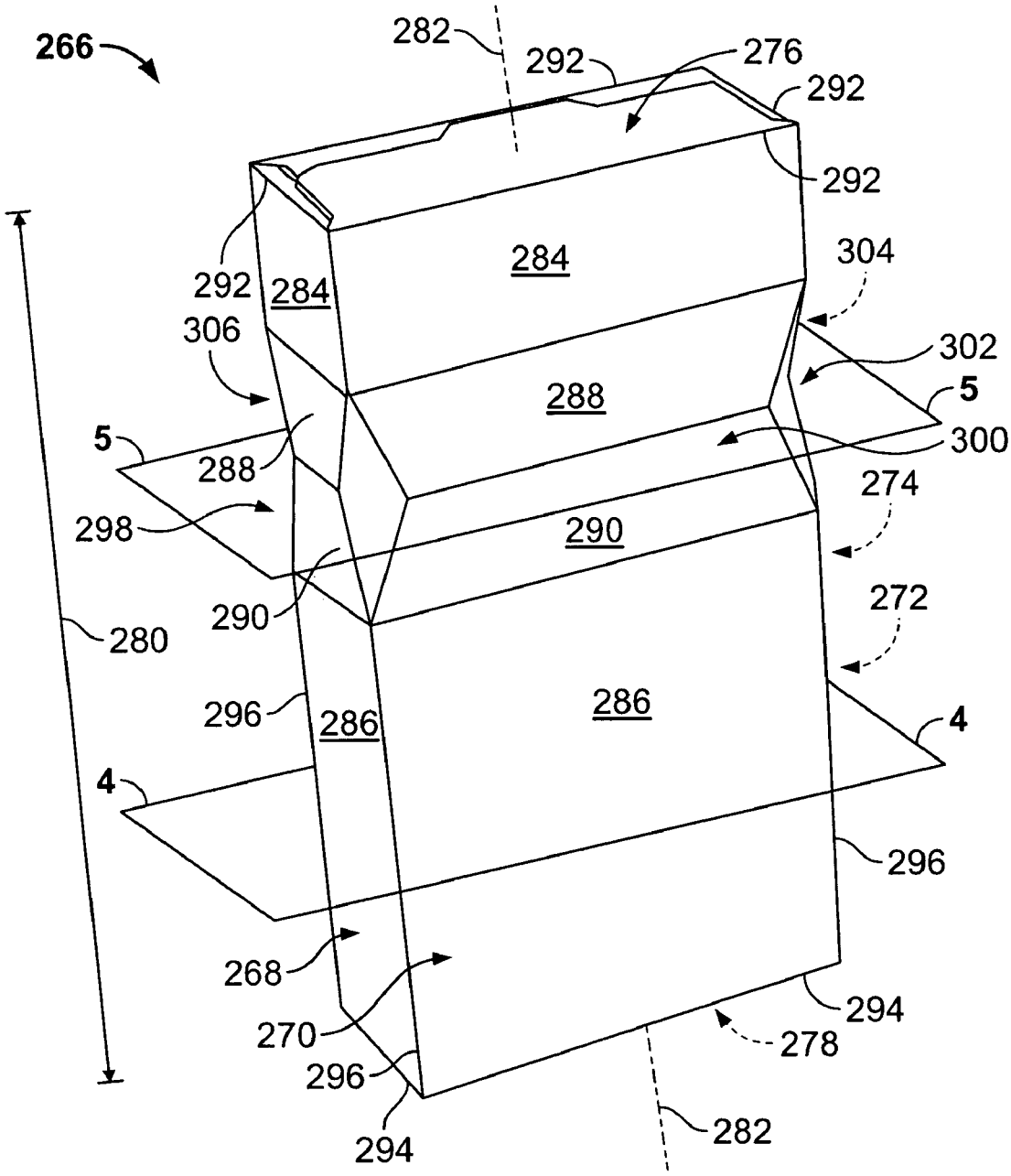
FIG. 5 is a perspective view of an exemplary embodiment of a carton formed from the blank shown in FIG. 4.
Figure 6:
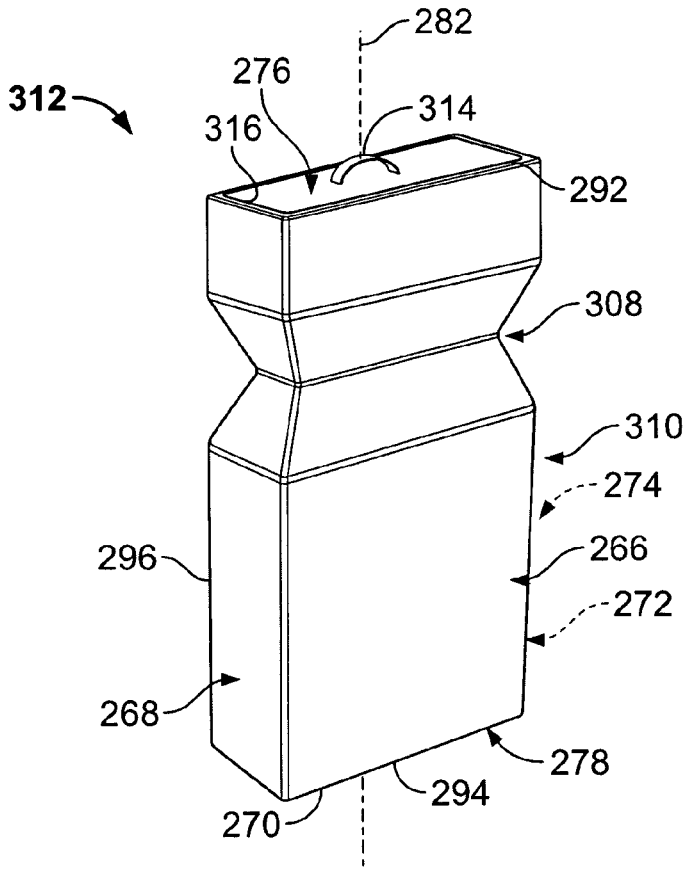
FIG. 6 is a perspective view of an exemplary embodiment of a packaging assembly including the carton shown in FIG. 5.
Figure 7:
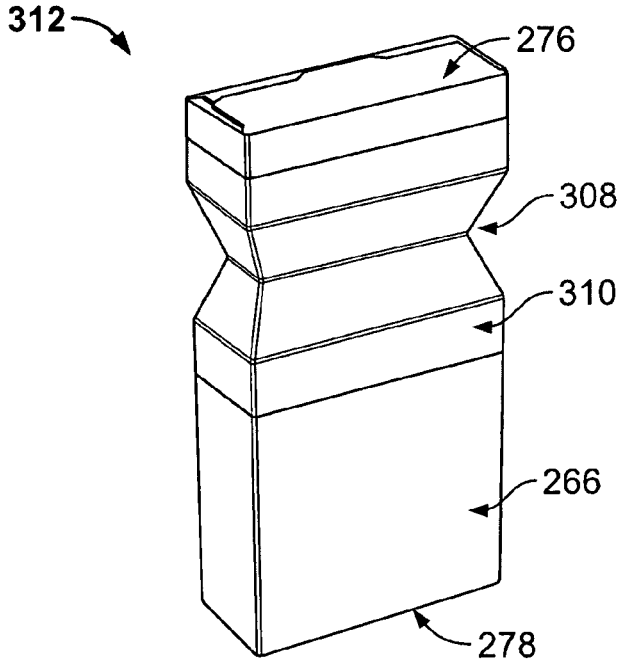
FIG. 7 is a perspective view of an alternative embodiment of the packaging assembly shown in FIG. 6.

Although as described above a package assembly may have any suitable size, shape, and/or configuration (e.g., number of sides), FIGS. 4-7 illustrate the formation of one embodiment of a package assembly. Specifically, FIG. 4 is a top plan view of one embodiment of a blank of sheet material (designated in its entirety by the reference numeral 200). FIG. 5 is a perspective view of one embodiment of a carton (designated in its entirety by 266) formed from the blank 200 shown in FIG. 4. FIG. 6 is a perspective view of one embodiment of a packaging assembly (designated in its entirety by 312) including the carton 266 shown in FIG. 5. FIG. 7 is a perspective view of an alternative embodiment of the packaging assembly 312 shown in FIG. 6.

Referring to FIG. 4, the blank 200 includes a succession of four side panels 202, 204, 206, and 208 that are connected together by a plurality of preformed, generally parallel, fold lines 210, 212, and 214, respectively. Specifically, each of the side panels 202, 204, 206, and 208 extends from an adjacent one of the side panels along the respective fold lines 210, 212, and 214. A side panel flap 216 extends from an end portion (generally designated by 218) of the side panel 208, or alternatively from an end portion (generally designated by 220) of the side panel 202, along a fold line 222 for facilitating securing the end portions 218 and 220 together to form the carton 266 (shown in FIG. 5). Each of the side panels 202, 204, 206, and 208 extends a height measured between a bottom end 224 and a top end 226.

The side panel 202 and the side panel 206 each include a top support panel 228 extending from the top end 226 thereof along a fold line 230 and a bottom support panel 232 extending from the bottom end 224 thereof along a fold line 234. Additionally, the side panel 204 and the side panel 208 each include a top panel 236 extending from the top end 226 thereof along a fold line 238 and a bottom panel 240 extending from the bottom end 224 thereof along a fold line 242. In one embodiment, at least one of the top panels 236 includes an extension 244 extending therefrom for interconnection with a slot 246 within the other top panel 236 for facilitating securing the top panels 236 together to form a top 276 (shown in FIG. 5) of the carton 266 (shown in FIG. 5). Similarly, in one embodiment (not shown), at least one of the bottom panels 240 includes an extension extending therefrom for interconnection with a slot within the other bottom panel 240 for facilitating securing the bottom panels 240 together to form a bottom 278 (shown in FIG. 5) of the carton 266 (shown in FIG. 5). Of course, the top panels 236 and the bottom panels 240 may include any suitable interconnection means in addition to, or alternatively to, the extension 244/slot 246 arrangement described above. Accordingly, the top and bottom panels 236 and 240, respectively, are not limited to interconnection using an extension/slot arrangement. For example, in one embodiment, adhesive is applied to portions of the top and bottom panels 236 and 240, respectively. In another embodiment, at least one of the top panels 236 and the bottom panels 240 interconnect using hook and loop fasteners 248.

The side panels 202, 204, 206, and 208 each include an upper panel portion 250 and a lower panel portion 252. The upper panel portions 250 each include an upper panel extension 254 extending therefrom along a fold line 256, and the lower panel portions 252 each include a lower panel extension 258 extending therefrom along a fold line 260. The upper panel extensions 254 are each joined to a corresponding lower panel extension 258 along a central fold line 262. As can be seen in FIG. 4, an opening 264 is defined between adjacent pairs of joined upper and lower panel extensions 254 and 258 to accommodate changing a cross-sectional area of the carton 266 as will be described below.

As shown in FIG. 5, a carton 266 can be formed from the blank 200 (shown in FIG. 4) by folding the blank about the various fold lines 210, 212, 214, 222, 230, 234, 238, and 242 (shown in FIG. 4). In one embodiment, an adhesive may be applied to portions of the blank 200 to secure the carton 266 together. Generally, the side panels 202, 204, 206, and 208 (shown in FIG. 4) form four successive sides (generally designated by 268, 270, 272, and 274) of the carton 266, the top panels 236 (shown in FIG. 4) form a top (generally designated by 276) of the carton 266, and the bottom panels 240 (shown in FIG. 4) form a bottom (generally designated by 278) of the carton 266. The carton 266 extends a height 280 measured between the top 276 and the bottom 278 of the carton 266 along a central longitudinal axis 282 extending through the carton 266. As can be seen in FIG. 5, in one embodiment, the carton 266 includes a generally rectangular cross-sectional shape, for example, a cross section taken along the plane 4-4 extending generally perpendicularly to the central longitudinal axis 282. As can also be seen in FIG. 5, each of the sides 268, 270, 272, and 274 extends between the top 276 and the bottom 278 of the carton 266. More specifically, in one embodiment, each of the sides 268, 270, 272, and 274 extends from the top 276 to the bottom 278. Any of the sides 268, 270, 272, and 274 may be referred to herein as a first, a second, a third, and/or a fourth side.

The upper panel portions 250 and the lower panel portions 252 (shown in FIG. 4) form upper portions 284 and lower portions 286, respectively, of each of the sides 268, 270, 272, and 274. The upper panel extensions 254 and the lower panel extensions 258 form upper extensions 288 and lower extensions 290, respectively, of each of the sides 268, 270, 272, and 274. A corner 292 is defined at an intersection between the top 276 and each of the sides 268, 270, 272, and 274. Similarly, a corner 294 is defined at an intersection between the bottom 278 and each of the sides 268, 270, 272, and 274. Moreover, a corner 296 is defined at an intersection between each adjacent side of the sides 268, 270, 272, and 274.

The upper and lower extensions 288 and 290 each form a movable section (generally designated by 298, 300, 302, and 304) of the carton 266. As can be seen in FIG. 5, in one embodiment, each of the movable sections 298, 300, 302, and 304 are located along the central longitudinal axis 282 at a generally equal distance from the top 276. More specifically, each of the central fold lines 262 (shown in FIG. 4) is located along the central longitudinal axis 282 at a generally equal distance from the top 276. Any of the movable sections 298, 300, 302, and 304 may be referred to herein as a first, a second, a third, and/or a fourth movable section.

The movable sections 298, 300, 302, and 304 are each movable between a first position shown in FIG. 5 (and generally designated by 306) and a second position shown in FIG. 6 (and generally designated by 308). In one embodiment, the movable sections 298, 300, 302, and 304 are movable from the first position 306 to the second position 308 by bending the upper and lower extensions 288 and 290, respectively, along the fold lines 256, the fold lines 260, and the central fold lines 262 to generally radially move the central fold lines 262 with respect to the central longitudinal axis 282 of the carton 266. Accordingly, and as can be seen in FIGS. 5 and 6, movement between the first and second positions 306 and 308, respectively, varies, or changes, a cross-sectional width of the carton 266 defined between two opposite sides of the sides 268, 270, 272, and 274 along the height of the carton 266. In one embodiment, a cross-sectional width defined between two opposite sides of the sides 268, 270, 272, and 274 and taken through the movable sections 298, 300, 302, and 304 (e.g., a cross section taken alone plane 5-5 in FIG. 5) is generally greater in the first position 306 than in the second position 308. More specifically, as can be seen in FIGS. 5 and 6, each of the central fold lines 262 is spaced a greater radial distance from the central longitudinal axis 282 in the first position 306 than in the second position 308. In one embodiment, at least one of the movable sections 298, 300, 302, and 304 is biased in the first position 306. Although the movable sections 298, 300, 302, and 304 may be biased in the first position 306 using any suitable mechanism, in one embodiment, a structure of the carton 266 biases the movable sections 298, 300, 302, and 304.

Once the carton 266 has been formed, and either before, simultaneously with, or after a product is placed within the carton 266, a heat-shrinkable layer (generally designated by 310) can be wrapped around at least a portion of the carton 266 and heat-shrunk to form a package assembly, one embodiment of which is shown in FIG. 6 and generally designated by 312. Specifically, in the embodiment shown in FIG. 6 the heat-shrinkable layer 310 is wrapped around the sides 268, 270, 272, and 274, a portion of which extends beyond the top 276 and another portion of which extends beyond the bottom 278. The layer 310 is then heated to shrink the heat-shrinkable layer into contact with the carton 266. The layer 310 shrinks to fit snuggly around the carton 266. Although the heat-shrinkable layer 310 can overlap any portion of the carton 266, in the embodiment shown in FIG. 6 the heat-shrunk layer 310 substantially overlaps the sides 268, 270, 272, and 274 and the corners 292, 294, and 296, and overlaps a portion of the top 276 and at least a portion of the bottom 278. FIG. 7 illustrates an alternative embodiment of the package assembly 312 wherein the layer 310 does not overlap any portion of the top 276 or the bottom 278 of the carton 266. Although other types of heat-shrinkable layers may be used, in one embodiment the heat-shrinkable layer 310 is a sheet of material or a sleeve of material. Additionally, although other materials may be used for the layer 310, in one embodiment the layer 310 includes polyethylene, polypropylene, polyvinyl chloride, polyester glycol, nylon, and/or oriented polystyrene.

The heat-shrunk layer 310 may facilitate sealing the carton 266 to protect a product contained within the carton from tampering and to generally seal the corners/joints of the carton 266 for containing the product within the carton 266 as well as protecting the product from contamination. The heat-shrunk layer 310 can be used, for example, to replace bags or liners sometimes used within a container for sealing a product. The tight fit of the heat-shrunk layer 310 may also facilitate maintaining a shape of the carton 266 for example, to facilitate displaying, stacking and/or arranging the carton 266 or a plurality thereof of cartons, and/or maintaining a shape that facilitates other functionality such as carrying the carton.

In one embodiment, the top 276 (and/or one or more of the sides 268, 270, 272, and 274) includes a handle 314 extending outwardly therefrom for carrying the assembly. The heat-shrunk layer 310 includes an opening 316 therein adjacent the handle 314 such that the handle 314 extends through the opening 316 allowing access to the handle when the heat-shrunk layer 310 overlaps a portion of the carton 266.

In one embodiment, the carton 266 and/or the layer 310 includes a marking thereon, such as, but not limited to, indicia that communicates the product, a manufacturer of the product, and/or a seller of the product. For example, printed text that indicates a product's name and briefly describes the product, logos and trademarks that indicate a manufacturer and/or seller of the product, and/or designs and/or ornamentation that attracts attention.

The heat-shrinkable layer 310 may also facilitate forming of the carton, and more specifically moving the moveable sections 298, 300, 302, and 304 from the first position 306 to the second position 308 to form the package assembly 312. As described above, cartons having shapes that are more complex than conventional rectangular cartons may be difficult and therefore costly to manufacture.

However, in one embodiment the heat-shrinkable layer 310 is wrapped around the carton 266 such that the heat-shrinkable layer 310 overlaps at least a portion of one or more of the movable sections 298, 300, 302, and 304. As the layer 310 is heated and shrinks into contact with the movable sections 298, 300, 302, and 304, the layer moves the movable sections 298, 300, 302, and 304 from the first position 306 (shown in FIG. 5) to the second position 308 to form a shape of the package assembly 312. The heat-shrunk layer 310 then holds the movable sections 298, 300, 302, and 304 in the second position 308 as long as the layer 310 remains substantially wrapped around the carton 266. In one embodiment wherein the movable sections 298, 300, 302, and 304 are biased to the first position, the layer 310 moves the movable sections to, and holds the movable section in, the second position 308 against the bias. By moving and holding the movable sections 298, 300, 302, and 304 into the second position 308, the layer 310 facilitates forming a shape of the package assembly 312, and more specifically the carton 266, that may be otherwise difficult and costly to form.

Figure 8:
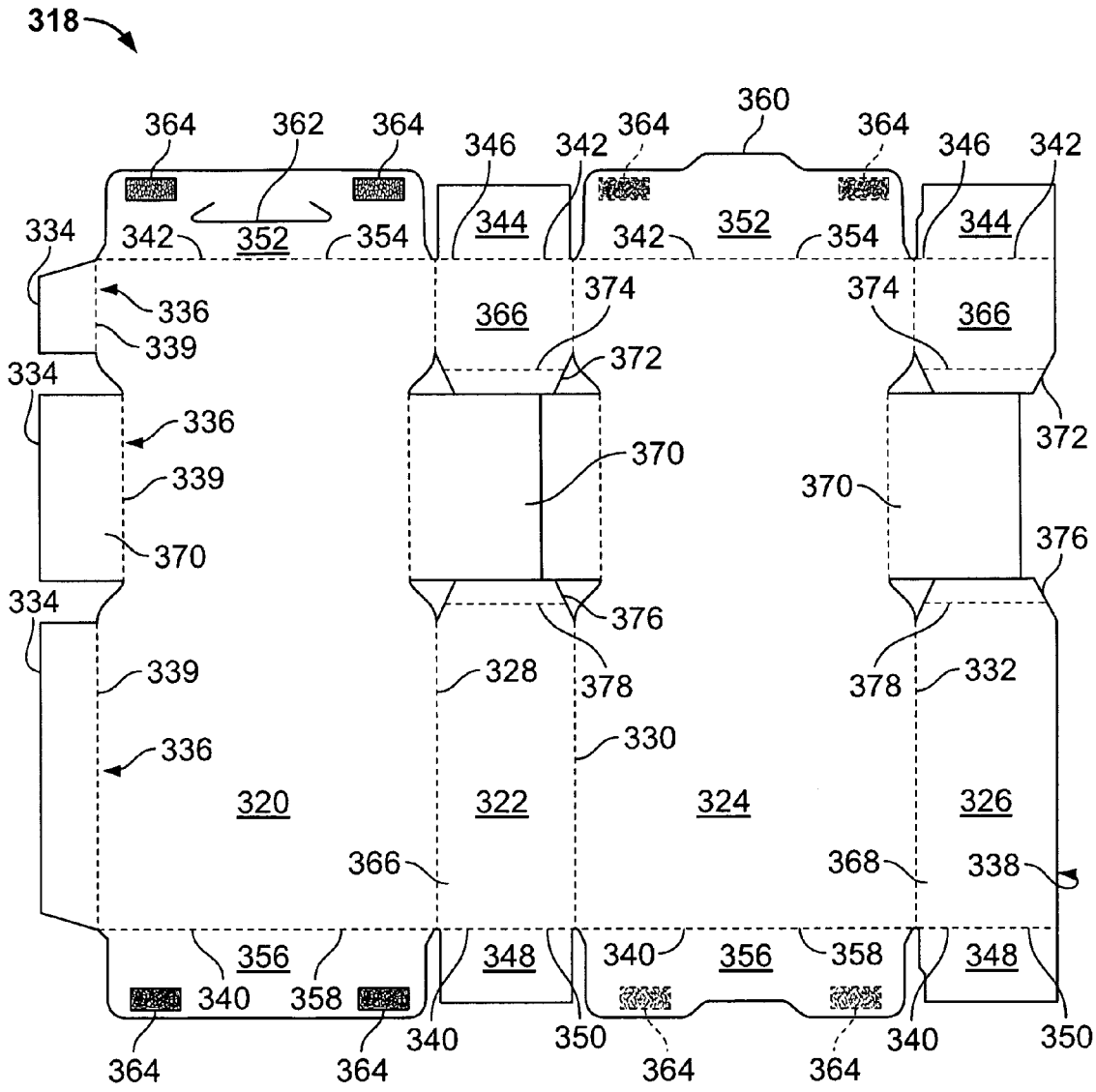
FIG. 8 is a top plan view of an exemplary embodiment of a blank of sheet material for forming another exemplary carton.
Figure 9:
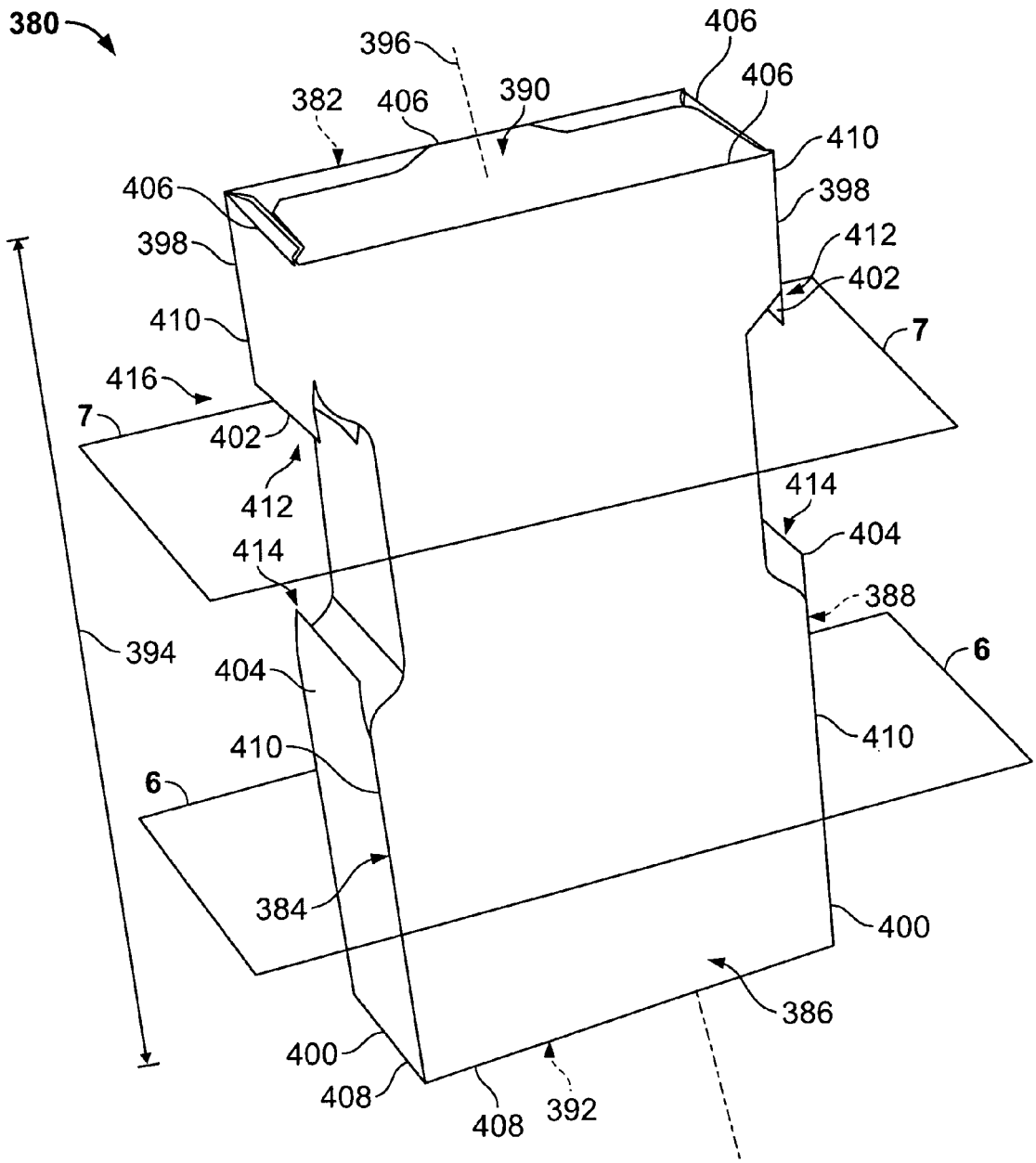
FIG. 9 is a perspective view of an exemplary embodiment of a carton formed from the blank shown in FIG. 8.
Figure 10:
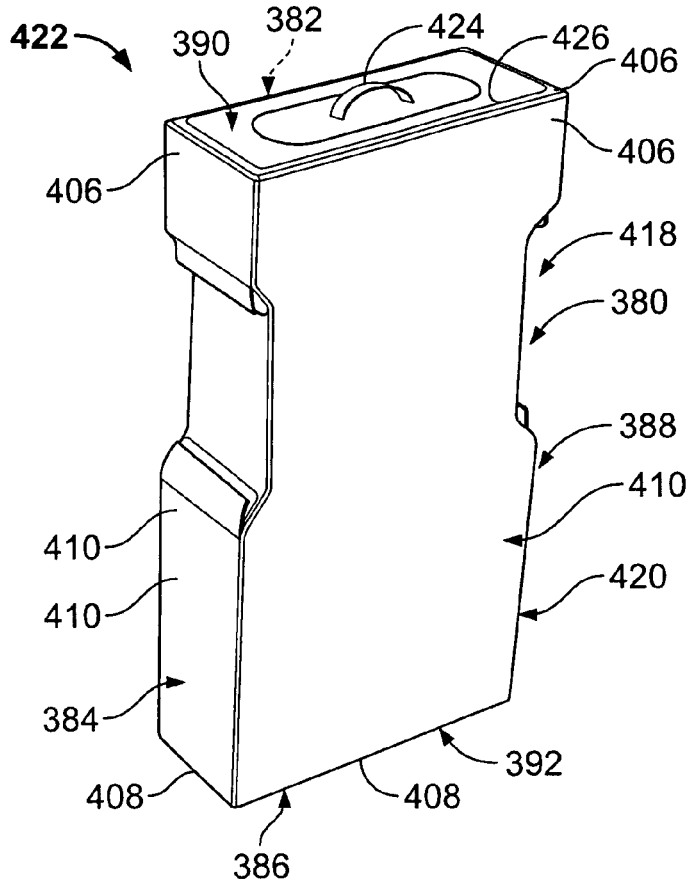
FIG. 10 is a perspective view of an exemplary embodiment of a packaging assembly including the carton shown in FIG. 9.
Figure 11:
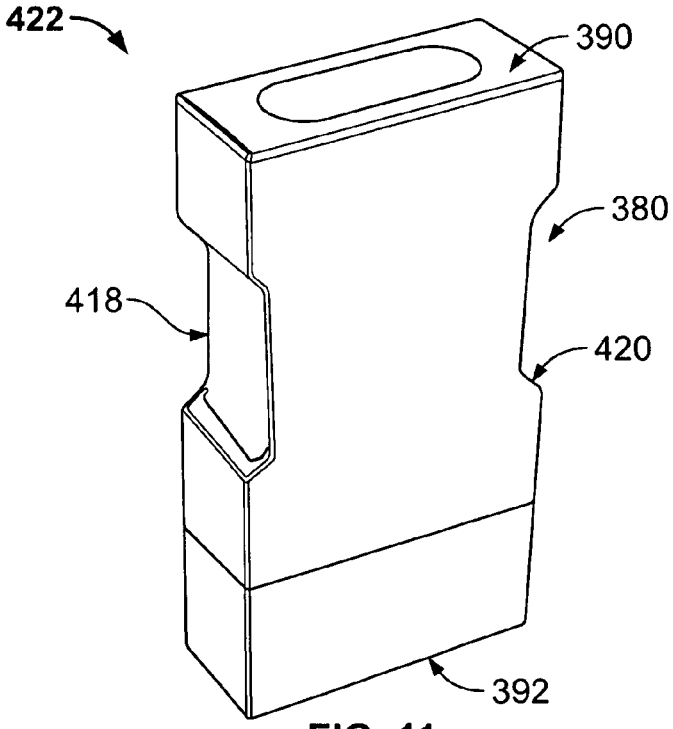
FIG. 11 is a perspective view of an alternative embodiment of the packaging assembly shown in FIG. 10.

Although as described above a package assembly may have any suitable size, shape, and/or configuration (e.g., number of sides), FIGS. 8-11 illustrate the formation of one embodiment of a package assembly. Specifically, FIG. 8 is a top plan view of one embodiment of a blank of sheet material (designated in its entirety by the reference numeral 318). FIG. 9 is a perspective view of one embodiment of a carton (designated in its entirety by 380) formed from the blank 318 shown in FIG. 8. FIG. 10 is a perspective view of one embodiment of a packaging assembly (designated in its entirety by 422) including the carton 380 shown in FIG. 9. FIG. 11 is a perspective view of an alternative embodiment of the packaging assembly 422 shown in FIG. 10.

Referring to FIG. 8, the blank 318 includes a succession of four side panels 320, 322, 324, and 326 that are connected together by a plurality of preformed, generally parallel, fold lines 328, 330, and 332, respectively. Specifically, each of the side panels 320, 322, 324, and 326 extends from an adjacent one of the side panels along the respective fold lines 328, 330, and 332. A side panel flap 334 extends from an end portion (generally designated by 336) of the side panel 320, or alternatively from an end portion (generally designated by 338) of the side panel 326, along a fold line 339 for facilitating securing the end portions 336 and 338 together to form the carton 380 (shown in FIG. 9). Each of the side panels 320, 322, 324, and 326 extends a height measured between a bottom end 340 and a top end 342.

The side panel 322 and the side panel 326 each include a top support panel 344 extending from the top end 342 thereof along a fold line 346 and a bottom support panel 348 extending from the bottom end 340 thereof along a fold line 350. Additionally, the side panel 320 and the side panel 324 each include a top panel 352 extending from the top end 342 thereof along a fold line 354 and a bottom panel 356 extending from the bottom end 340 thereof along a fold line 358. In one embodiment, at least one of the top panels 352 includes an extension 360 extending therefrom for interconnection with a slot 362 within the other top panel 352 for facilitating securing the top panels 352 together to form a top 390 (shown in FIG. 9) of the carton 380 (shown in FIG. 9). Similarly, in one embodiment (not shown), at least one of the bottom panels 356 includes an extension extending therefrom for interconnection with a slot within the other bottom panel 356 for facilitating securing the bottom panels 356 together to form a bottom 392 (shown in FIG. 9) of the carton 380 (shown in FIG. 9). Of course, the top panels 352 and the bottom panels 356 may include any suitable interconnection means in addition to, or alternatively to, the extension 360/slot 362 arrangement described above. Accordingly, the top and bottom panels 352 and 356, respectively, are not limited to interconnection using an extension/slot arrangement. For example, in one embodiment, adhesive is applied to portions of the top and bottom panels 352 and 356, respectively. In another embodiment, at least one of the top panels 352 and the bottom panels 356 interconnect using hook and loop fasteners 364.

The side panels 322 and 326 each include an upper panel portion 366, a lower panel portion 368, and an intermediate panel portion 370. The upper panel portions 366 each include an upper panel extension 372 extending therefrom along a fold line 374, and the lower panel portions 368 each include a lower panel extension 376 extending therefrom along a fold line 378.

As shown in FIG. 9, a carton 380 can be formed from the blank 318 (shown in FIG. 8) by folding the blank about the various fold lines 328, 330, 332, 339 350, 346, 350, 354, and 358 (shown in FIG. 8). In one embodiment, an adhesive may be applied to portions of the blank 318 to secure the carton 380 together. Generally, the side panels 320, 322, 324, and 326 (shown in FIG. 8) form four successive sides (generally designated by 382, 384, 386, and 388) of the carton 380, the top panels 352 (shown in FIG. 8) form a top (generally designated by 390) of the carton 380, and the bottom panels 356 (shown in FIG. 8) form a bottom (generally designated by 392) of the carton 380. The carton 380 extends a height 394 measured between the top 390 and the bottom 392 of the carton 380 along a central longitudinal axis 396 extending through the carton 380. As can be seen in FIG. 9, in one embodiment, the carton 380 includes a generally rectangular cross-sectional shape, for example, a cross section taken along the plane 6-6 extending generally perpendicularly to the central longitudinal axis 396. As can also be seen in FIG. 9, each of the sides 382, 384, 386, and 388 extends between the top 390 and the bottom 392 of the carton 380. More specifically, in one embodiment, each of the sides 382, 384, 386, and 388 extends from the top 390 to the bottom 392. Any of the sides 382, 384, 386, and 388 may be referred to herein as a first, a second, a third, and/or a fourth side.

The upper panel portions 366 and the lower panel portions 368 (shown in FIG. 8) form upper portions 398 and lower portions 400, respectively, of each of the sides 388 and 384. The upper panel extensions 372 and the lower panel extensions 376 form upper extensions 402 and lower extensions 404, respectively, of each of the sides 388 and 384. A corner 406 is defined at an intersection between the top 390 and each of the sides 382, 384, 386, and 388. Similarly, a corner 408 is defined at an intersection between the bottom 392 and each of the sides 382, 384, 386, and 388. Moreover, a corner 410 is defined at an intersection between each adjacent side of the sides 382, 384, 386, and 388.

The upper and lower extensions 402 and 404 each form a movable section (generally designated by 412 and 414) of the carton 380. Any of the movable sections 412 and 414 may be referred to herein as a first, a second, a third, and/or a fourth movable section. The movable sections 412 and 414 are each movable between a first position shown in FIG. 9 (and generally designated by 416) and a second position shown in FIG. 10 (and generally designated by 418). In one embodiment, the movable sections 412 and 414 are movable from the first position 416 to the second position 418 by bending the upper and lower extensions 402 and 404, respectively, along the fold lines 374 and the fold lines 378 generally toward the central longitudinal axis 396 of the carton 380 and such that the extensions 402 and 404 are obliquely angled with respect to the corresponding side 384, 388. Accordingly, and as can be seen in FIGS. 9 and 10, movement between the first and second positions 416 and 418, respectively, varies, or changes, a cross-sectional width of the carton 380 defined between the two opposite sides of the sides 384 and 388 along the height of the carton 380. In one embodiment, a cross-sectional width defined between the two opposite sides 384 and 388 and generally adjacent the movable sections 412 and 414 (e.g., a cross section taken alone plane 7-7 in FIG. 9) is generally greater in the first position 416 than in the second position 418. In one embodiment, at least one of the movable sections 412 and 414 is biased in the first position 416. Although the movable sections 412 and 414 may be biased in the first position 416 using any suitable mechanism, in one embodiment, a structure of the carton 380 biases the movable sections 412 and 414.

Once the carton 380 has been formed, and either before, simultaneously with, or after a product is placed within the carton 380, a heat-shrinkable layer (generally designated by 420) can be wrapped around at least a portion of the carton 380 and heat-shrunk to form a package assembly, one embodiment of which is shown in FIG. 10 and generally designated by 422. Specifically, in the embodiment shown in FIG. 10 the heat-shrinkable layer 420 is wrapped around the sides 382, 384, 386, and 388, a portion of which extends beyond the top 390 and another portion of which extends beyond the bottom 392. The layer 420 is then heated to shrink the heat-shrinkable layer into contact with the carton 380. The layer 420 shrinks to fit snuggly around the carton 380. Although the heat-shrinkable layer 420 can overlap any portion of the carton 380, in the embodiment shown in FIG. 10 the heat-shrunk layer 420 substantially overlaps the sides 382, 384, 386, and 388 and the corners 406, 408, and 410, and overlaps a portion of the top 390 and at least a portion of the bottom 392. FIG. 11 illustrates an alternative embodiment of the package assembly 422 wherein the layer 420 does not overlap any portion of the top 390 or the bottom 392 of the carton 380. Although other types of heat-shrinkable layers may be used, in one embodiment the heat-shrinkable layer 420 is a sheet of material or a sleeve of material. Additionally, although other materials may be used for the layer 420, in one embodiment the layer 420 includes polyethylene, polypropylene, polyvinyl chloride, polyester glycol, nylon, and/or oriented polystyrene.

The heat-shrunk layer 420 may facilitate sealing the carton 380 to protect a product contained within the carton from tampering and to generally seal the corners/joints of the carton 380 for containing the product within the carton 380 as well as protecting the product from contamination. The heat-shrunk layer 420 can be used, for example, to replace bags or liners sometimes used within a container for sealing a product. The tight fit of the heat-shrunk layer 420 may also facilitate maintaining a shape of the carton 380 for example, to facilitate displaying, stacking and/or arranging the carton 380 or a plurality thereof of cartons, and/or maintaining a shape that facilitates other functionality such as carrying the carton.

In one embodiment, the top 390 (and/or one or more of the sides 382, 384, 386, and 388) includes a handle 424 extending outwardly therefrom for carrying the assembly. The heat-shrunk layer 420 includes an opening 426 therein adjacent the handle 424 such that the handle 424 extends through the opening 426 allowing access to the handle when the heat-shrunk layer 420 overlaps a portion of the carton 380.

In one embodiment, the carton 380 and/or the layer 420 includes a marking thereon, such as, but not limited to, indicia that communicates the product, a manufacturer of the product, and/or a seller of the product. For example, printed text that indicates a product's name and briefly describes the product, logos and trademarks that indicate a manufacturer and/or seller of the product, and/or designs and/or ornamentation that attracts attention.

The heat-shrinkable layer 420 may also facilitate forming of the carton, and more specifically moving the moveable sections 412 and 414 from the first position 416 to the second position 418 to form the package assembly 422. As described above, cartons having shapes that are more complex than conventional rectangular cartons may be difficult and therefore costly to manufacture.

However, in one embodiment the heat-shrinkable layer 420 is wrapped around the carton 380 such that the heat-shrinkable layer 420 overlaps at least a portion of one or more of the movable sections 412 and 414. As the layer 420 is heated and shrinks into contact with the movable sections 412 and 414, the layer moves the movable sections 412 and 414 from the first position 416 (shown in FIG. 9) to the second position 418 to form a shape of the package assembly 422. The heat-shrunk layer 420 then holds the movable sections 412 and 414 in the second position 418 as long as the layer 420 remains substantially wrapped around the carton 380. In one embodiment wherein the movable sections 412 and 414 are biased to the first position, the layer 420 moves the movable sections to, and holds the movable section in, the second position 418 against the bias. By moving and holding the movable sections 412 and 414 into the second position 418, the layer 420 facilitates forming a shape of the package assembly 422, and more specifically the carton 380, that may be otherwise difficult and costly to form.

Figure 12:
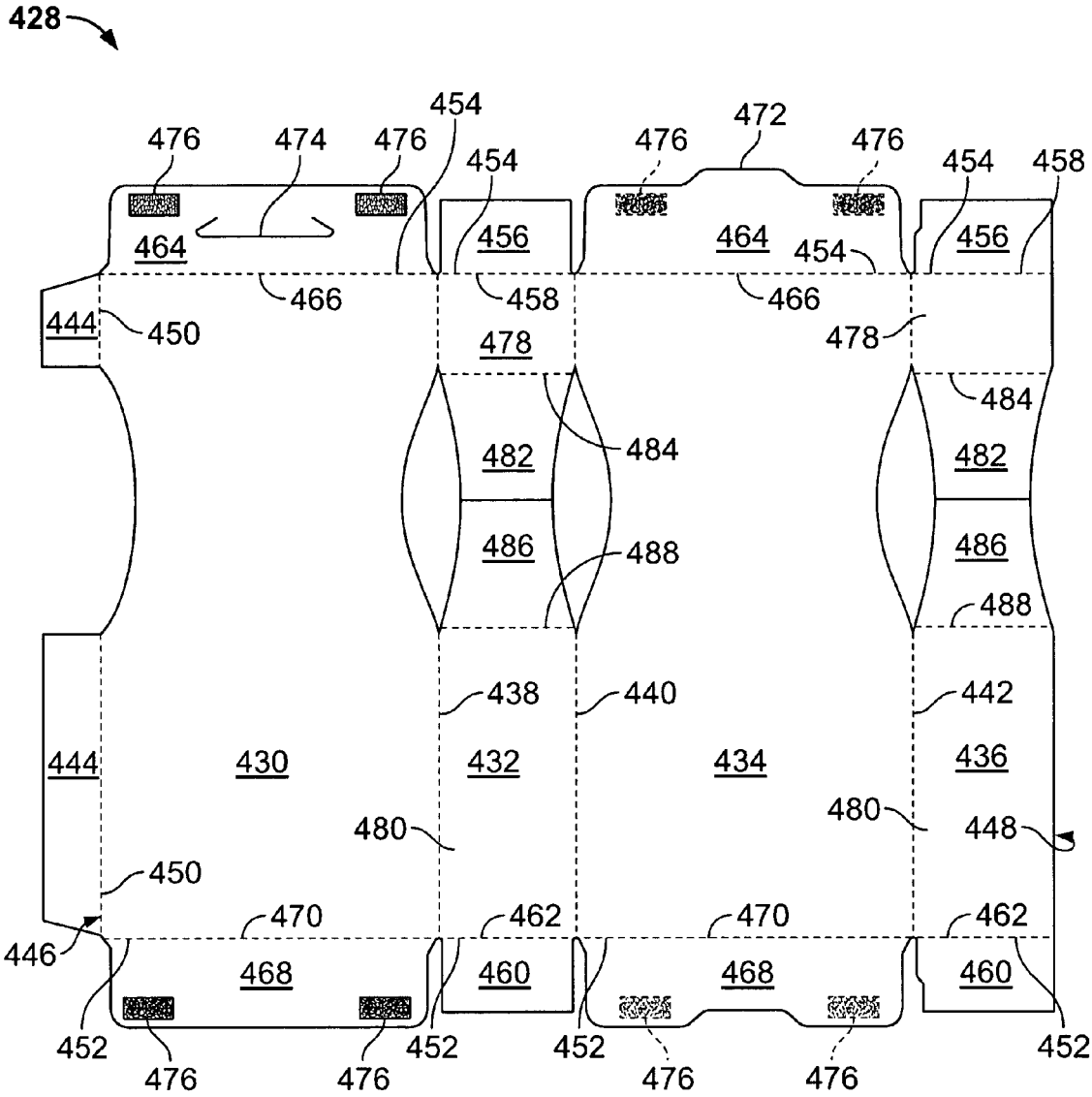
FIG. 12 is a top plan view of an exemplary embodiment of a blank of sheet material for forming another exemplary carton.
Figure 13:
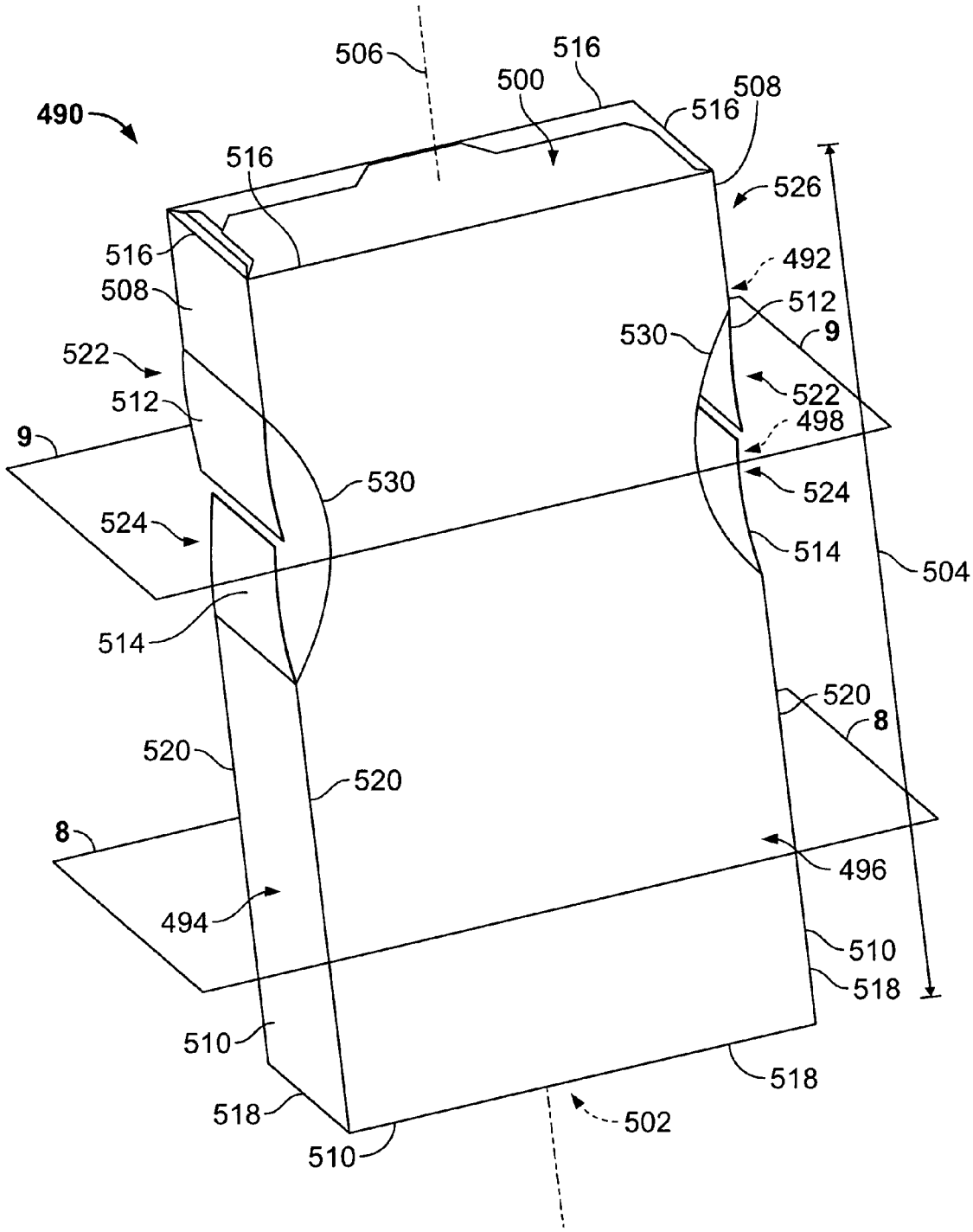
FIG. 13 is a perspective view of an exemplary embodiment of a carton formed from the blank shown in FIG. 12.
Figure 14:
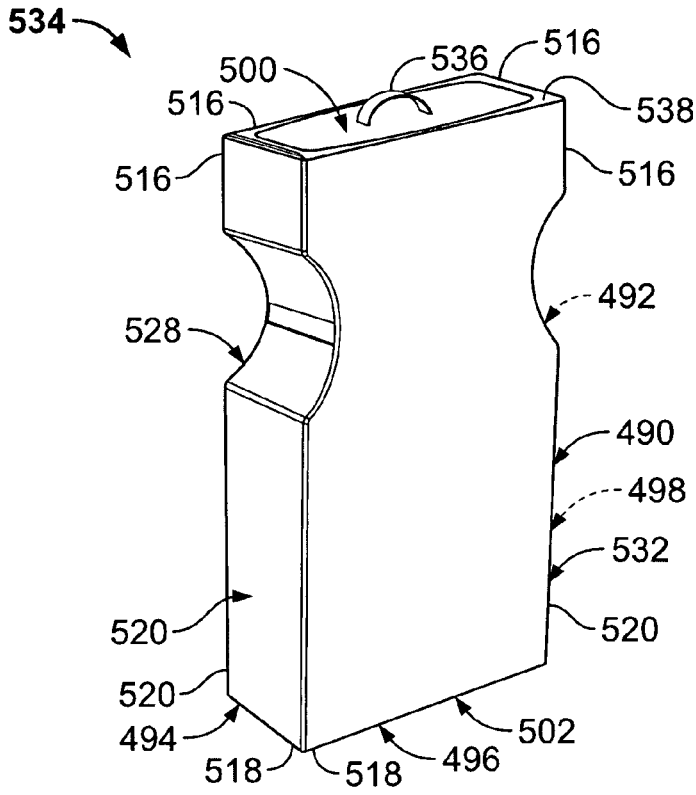
FIG. 14 is a perspective view of an exemplary embodiment of a packaging assembly including the carton shown in FIG. 13.
Figure 15:
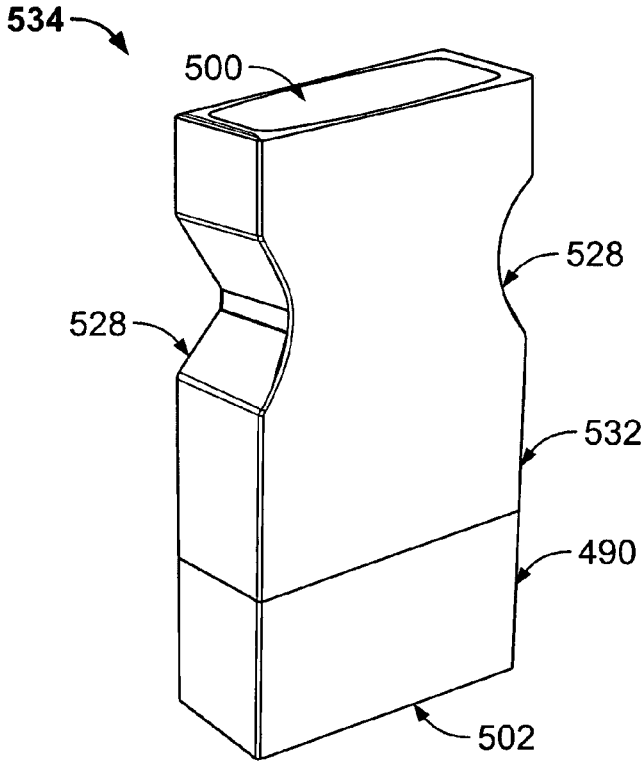
FIG. 15 is a perspective view of an alternative embodiment of the packaging assembly shown in FIG. 13.

Although as described above a package assembly may have any suitable size, shape, and/or configuration (e.g., number of sides), FIGS. 12-15 illustrate the formation of one embodiment of a package assembly. Specifically, FIG. 12 is a top plan view of one embodiment of a blank of sheet material (designated in its entirety by the reference numeral 428). FIG. 13 is a perspective view of one embodiment of a carton (designated in its entirety by 490) formed from the blank 428 shown in FIG. 12. FIG. 14 is a perspective view of one embodiment of a packaging assembly (designated in its entirety by 534) including the carton 490 shown in FIG. 13. FIG. 15 is a perspective view of an alternative embodiment of the packaging assembly 534 shown in FIG. 14.

Referring to FIG. 12, the blank 428 includes a succession of four side panels 430, 432, 434, and 436 that are connected together by a plurality of preformed, generally parallel, fold lines 438, 440, and 442, respectively. Specifically, each of the side panels 430, 432, 434, and 436 extends from an adjacent one of the side panels along the respective fold lines 438, 440, and 442. A side panel flap 444 extends from an end portion (generally designated by 446) of the side panel 430, or alternatively from an end portion (generally designated by 448) of the side panel 436, along a fold line 450 for facilitating securing the end portions 446 and 448 together to form the carton 490 (shown in FIG. 13). Each of the side panels 430, 432, 434, and 436 extends a height measured between a bottom end 452 and a top end 454.

The side panel 432 and the side panel 436 each include a top support panel 456 extending from the top end 454 thereof along a fold line 458 and a bottom support panel 460 extending from the bottom end 452 thereof along a fold line 462. Additionally, the side panel 430 and the side panel 434 each include a top panel 464 extending from the top end 454 thereof along a fold line 466 and a bottom panel 468 extending from the bottom end 452 thereof along a fold line 470. In one embodiment, at least one of the top panels 464 includes an extension 472 extending therefrom for interconnection with a slot 474 within the other top panel 464 for facilitating securing the top panels 464 together to form a top 500 (shown in FIG. 13) of the carton 490 (shown in FIG. 13). Similarly, in one embodiment (not shown), at least one of the bottom panels 468 includes an extension extending therefrom for interconnection with a slot within the other bottom panel 468 for facilitating securing the bottom panels 468 together to form a bottom 502 (shown in FIG. 13) of the carton 490 (shown in FIG. 13). Of course, the top panels 464 and the bottom panels 468 may include any suitable interconnection means in addition to, or alternatively to, the extension 472/slot 474 arrangement described above. Accordingly, the top and bottom panels 464 and 468, respectively, are not limited to interconnection using an extension/slot arrangement. For example, in one embodiment, adhesive is applied to portions of the top and bottom panels 464 and 468, respectively. In another embodiment, at least one of the top panels 464 and the bottom panels 468 interconnect using hook and loop fasteners 476.

The side panels 432 and 436 each include an upper panel portion 478 and a lower panel portion 480. The upper panel portions 478 each include an upper panel extension 482 extending therefrom along a fold line 484, and the lower panel portions 480 each include a lower panel extension 486 extending therefrom along a fold line 488.

As shown in FIG. 13, a carton 490 can be formed from the blank 428 (shown in FIG. 12) by folding the blank about the various fold lines 438, 440, 442, 462, 458, 462, 466, and 470 (shown in FIG. 12). In one embodiment, an adhesive may be applied to portions of the blank 428 to secure the carton 490 together. Generally, the side panels 430, 432, 434, and 436 (shown in FIG. 12) form four successive sides (generally designated by 492, 494, 496, and 498) of the carton 490, the top panels 464 (shown in FIG. 12) form a top (generally designated by 500) of the carton 490, and the bottom panels 468 (shown in FIG. 12) form a bottom (generally designated by 502) of the carton 490. The carton 490 extends a height 504 measured between the top 500 and the bottom 502 of the carton 490 along a central longitudinal axis 506 extending through the carton 490. As can be seen in FIG. 13, in one embodiment, the carton 490 includes a generally rectangular cross-sectional shape, for example, a cross section taken along the plane 8-8 extending generally perpendicularly to the central longitudinal axis 506. As can also be seen in FIG. 13, each of the sides 492, 494, 496, and 498 extends between the top 500 and the bottom 502 of the carton 490. More specifically, in one embodiment, each of the sides 492, 494, 496, and 498 extends from the top 500 to the bottom 502. Any of the sides 492, 494, 496, and 498 may be referred to herein as a first, a second, a third, and/or a fourth side.

The upper panel portions 478 and the lower panel portions 480 (shown in FIG. 12) form upper portions 508 and lower portions 510, respectively, of each of the sides 498 and 494. The upper panel extensions 482 and the lower panel extensions 486 form upper extensions 512 and lower extensions 514, respectively, of each of the sides 498 and 494. A corner 516 is defined at an intersection between the top 500 and each of the sides 492, 494, 496, and 498. Similarly, a corner 518 is defined at an intersection between the bottom 502 and each of the sides 492, 494, 496, and 498. Moreover, a corner 520 is defined at an intersection between each adjacent side of the sides 492, 494, 496, and 498.

The upper and lower extensions 512 and 514 each form a movable section (generally designated by 522 and 524) of the carton 490. Any of the movable sections 522 and 524 may be referred to herein as a first, a second, a third, and/or a fourth movable section. The movable sections 522 and 524 are each movable between a first position shown in FIG. 13 (and generally designated by 526) and a second position shown in FIG. 14 (and generally designated by 528). In one embodiment, the movable sections 522 and 524 are movable from the first position 526 to the second position 528 by bending the upper and lower extensions 512 and 514, respectively, along the fold lines 484 and the fold lines 488 generally toward the central longitudinal axis 506 of the carton 490 such that the extensions 512 and 514 are obliquely angled with respect to the corresponding side 494, 498. Accordingly, and as can be seen in FIGS. 13 and 14, movement between the first and second positions 526 and 528, respectively, varies, or changes, a cross-sectional width of the carton 490 defined between the two opposite sides of the sides 494 and 498 along the height of the carton 490. In one embodiment, the opposite sides 494 and 498 each include a curved edge 530 to accommodate the changing cross-sectional width. The curved edge 530 extends only a portion of the height 504 of the carton 490, although alternatively it may extend from the top 500 to the bottom 502. In one embodiment, a cross-sectional width defined between the two opposite sides 494 and 498 and generally adjacent the movable sections 522 and 524 (e.g., a cross section taken alone plane 9-9 in FIG. 13) is generally greater in the first position 526 than in the second position 528. In one embodiment, at least one of the movable sections 522 and 524 is biased in the first position 526. Although the movable sections 522 and 524 may be biased in the first position 526 using any suitable mechanism, in one embodiment, a structure of the carton 490 biases the movable sections 522 and 524.

Once the carton 490 has been formed, and either before, simultaneously with, or after a product is placed within the carton 490, a heat-shrinkable layer (generally designated by 532) can be wrapped around at least a portion of the carton 490 and heat-shrunk to form a package assembly, one embodiment of which is shown in FIG. 14 and generally designated by 534. Specifically, in the embodiment shown in FIG. 14 the heat-shrinkable layer 532 is wrapped around the sides 492, 494, 496, and 498, a portion of which extends beyond the top 500 and another portion of which extends beyond the bottom 502. The layer 532 is then heated to shrink the heat-shrinkable layer into contact with the carton 490. The layer 532 shrinks to fit snuggly around the carton 490. Although the heat-shrinkable layer 532 can overlap any portion of the carton 490, in the embodiment shown in FIG. 14 the heat-shrunk layer 532 substantially overlaps the sides 492, 494, 496, and 498 and the corners 516, 518, and 520, and overlaps a portion of the top 500 and at least a portion of the bottom 502. FIG. 15 illustrates an alternative embodiment of the package assembly 534 wherein the layer 532 does not overlap any portion of the top 500 or the bottom 502 of the carton 490. Although other types of heat-shrinkable layers may be used, in one embodiment the heat-shrinkable layer 532 is a sheet of material or a sleeve of material. Additionally, although other materials may be used for the layer 532, in one embodiment the layer 532 includes polyethylene, polypropylene, polyvinyl chloride, polyester glycol, nylon, and/or oriented polystyrene.

The heat-shrunk layer 532 may facilitate sealing the carton 490 to protect a product contained within the carton from tampering and to generally seal the corners/joints of the carton 490 for containing the product within the carton 490 as well as protecting the product from contamination. The heat-shrunk layer 532 can be used, for example, to replace bags or liners sometimes used within a container for sealing a product. The tight fit of the heat-shrunk layer 532 may also facilitate maintaining a shape of the carton 490 for example, to facilitate displaying, stacking and/or arranging the carton 490 or a plurality thereof of cartons, and/or maintaining a shape that facilitates other functionality such as carrying the carton.

In one embodiment, the top 500 (and/or one or more of the sides 492, 494, 496, and 498) includes a handle 536 extending outwardly therefrom for carrying the assembly. The heat-shrunk layer 532 includes an opening 538 therein adjacent the handle 536 such that the handle 536 extends through the opening 538 allowing access to the handle when the heat-shrunk layer 532 overlaps a portion of the carton 490.

In one embodiment, the carton 490 and/or the layer 532 includes a marking thereon, such as, but not limited to, indicia that communicates the product, a manufacturer of the product, and/or a seller of the product. For example, printed text that indicates a product's name and briefly describes the product, logos and trademarks that indicate a manufacturer and/or seller of the product, and/or designs and/or ornamentation that attracts attention.

The heat-shrinkable layer 532 may also facilitate forming of the carton, and more specifically moving the moveable sections 522 and 524 from the first position 526 to the second position 528 to form the package assembly 534. As described above, cartons having shapes that are more complex than conventional rectangular cartons may be difficult and therefore costly to manufacture.

However, in one embodiment the heat-shrinkable layer 532 is wrapped around the carton 490 such that the heat-shrinkable layer 532 overlaps at least a portion of one or more of the movable sections 522 and 524. As the layer 532 is heated and shrinks into contact with the movable sections 522 and 524, the layer moves the movable sections 522 and 524 from the first position 526 (shown in FIG. 13) to the second position 528 to form a shape of the package assembly 534. The heat-shrunk layer 532 then holds the movable sections 522 and 524 in the second position 528 as long as the layer 532 remains substantially wrapped around the carton 490. In one embodiment wherein the movable sections 522 and 524 are biased to the first position, the layer 532 moves the movable sections to, and holds the movable section in, the second position 528 against the bias. By moving and holding the movable sections 522 and 524 into the second position 528, the layer 532 facilitates forming a shape of the package assembly 534, and more specifically the carton 490, that may be otherwise difficult and costly to form.

Figure 16:
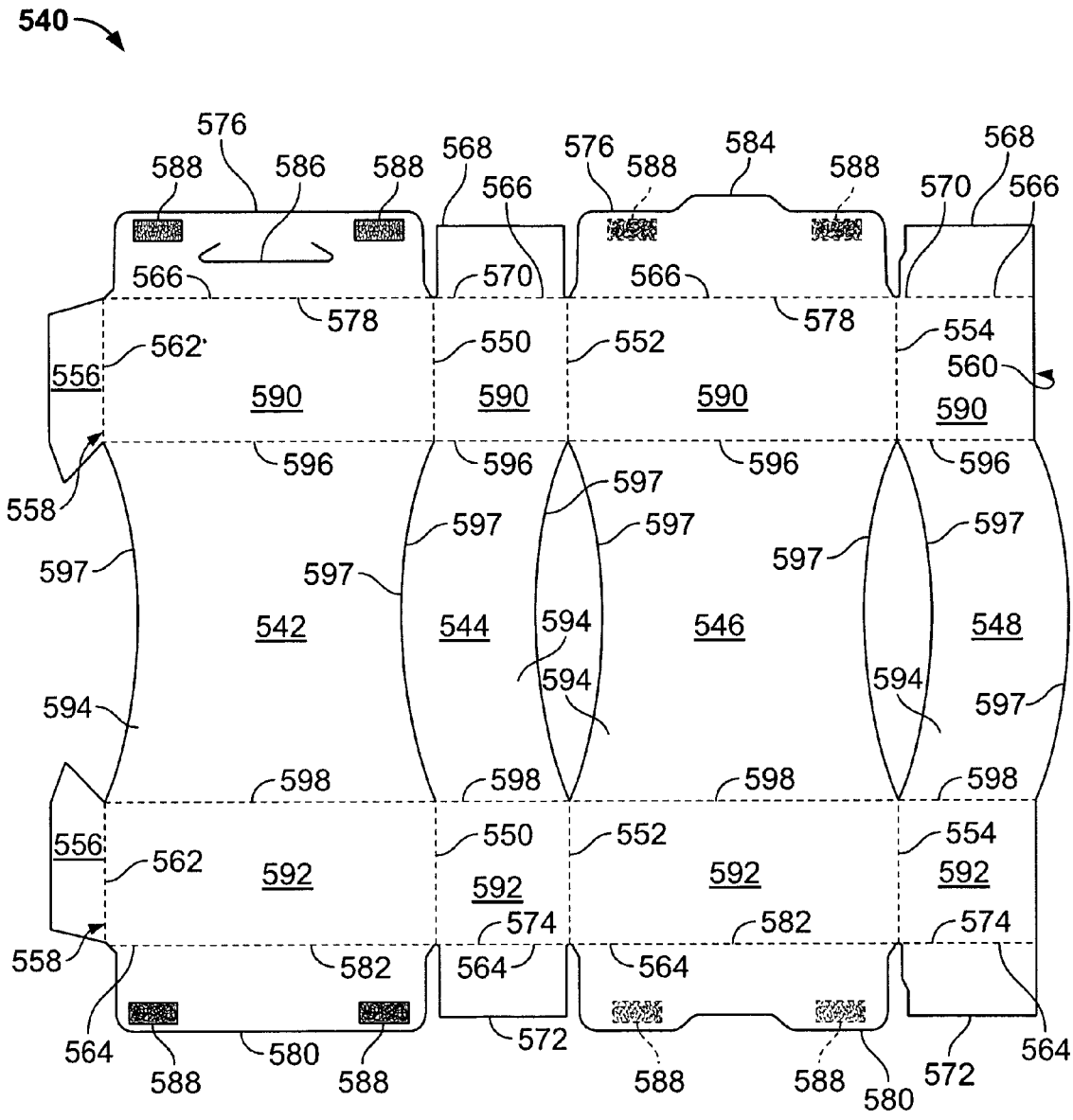
FIG. 16 is a top plan view of an exemplary embodiment of a blank of sheet material for forming another exemplary carton.
Figure 17:
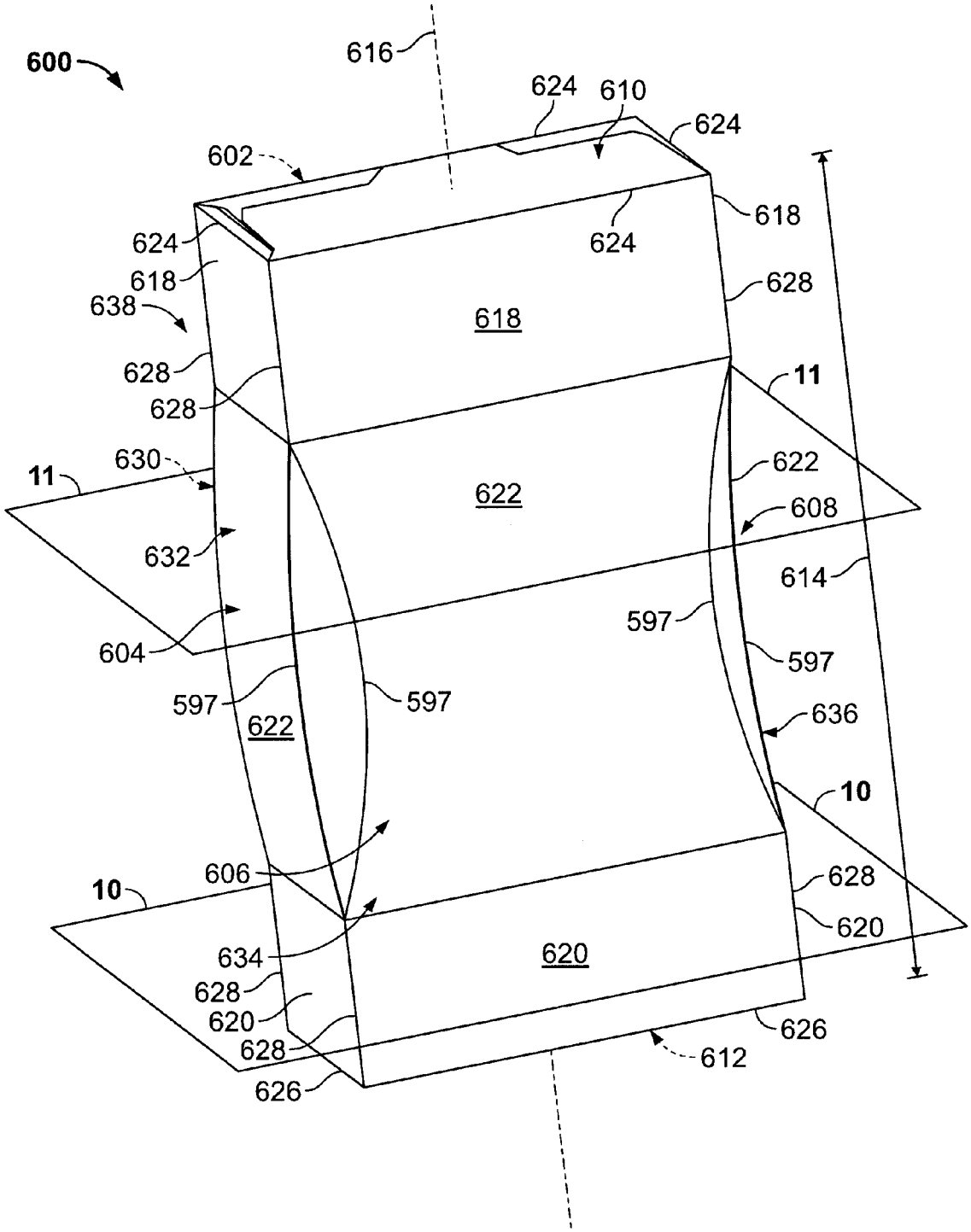
FIG. 17 is a perspective view of an exemplary embodiment of a carton formed from the blank shown in FIG. 16.
Figure 18:
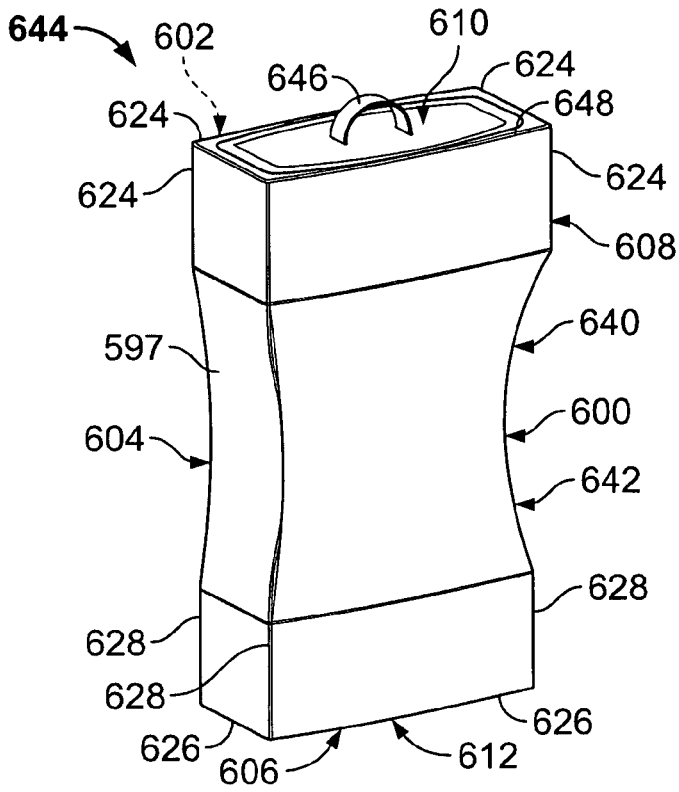
FIG. 18 is a perspective view of an exemplary embodiment of a packaging assembly including the carton shown in FIG. 17.
Figure 19:
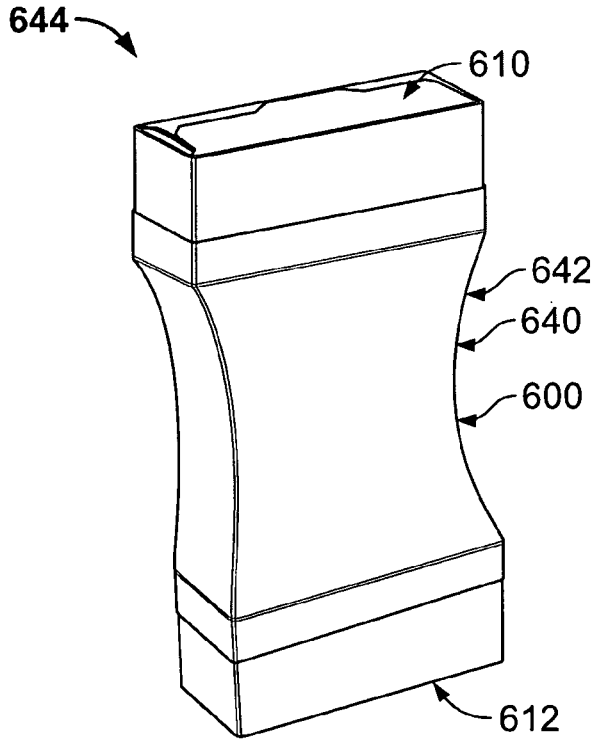
FIG. 19 is a perspective view of an alternative embodiment of the packaging assembly shown in FIG. 18.

Although as described above a package assembly may have any suitable size, shape, and/or configuration (e.g., number of sides), FIGS. 16-19 illustrate the formation of one embodiment of a package assembly. Specifically, FIG. 16 is a top plan view of one embodiment of a blank of sheet material (designated in its entirety by the reference numeral 540). FIG. 17 is a perspective view of one embodiment of a carton (designated in its entirety by 600) formed from the blank 540 shown in FIG. 16. FIG. 18 is a perspective view of one embodiment of a packaging assembly (designated in its entirety by 644) including the carton 600 shown in FIG. 17. FIG. 19 is a perspective view of an alternative embodiment of the packaging assembly 644 shown in FIG. 18.

Referring to FIG. 16, the blank 540 includes a succession of four side panels 542, 544, 546, and 548 that are connected together by a plurality of preformed, generally parallel, fold lines 550, 552, and 554, respectively. Specifically, each of the side panels 542, 544, 546, and 548 extends from an adjacent one of the side panels along the respective fold lines 550, 552, and 554. A side panel flap 556 extends from an end portion (generally designated by 558) of the side panel 542, or alternatively from an end portion (generally designated by 560) of the side panel 548, along a fold line 562 for facilitating securing the end portions 558 and 560 together to form the carton 600 (shown in FIG. 17). Each of the side panels 542, 544, 546, and 548 extends a height measured between a bottom end 564 and a top end 566.

The side panel 544 and the side panel 548 each include a top support panel 568 extending from the top end 566 thereof along a fold line 570 and a bottom support panel 572 extending from the bottom end 564 thereof along a fold line 574. Additionally, the side panel 542 and the side panel 546 each include a top panel 576 extending from the top end 566 thereof along a fold line 578 and a bottom panel 580 extending from the bottom end 564 thereof along a fold line 582. In one embodiment, at least one of the top panels 576 includes an extension 584 extending therefrom for interconnection with a slot 586 within the other top panel 576 for facilitating securing the top panels 576 together to form a top 610 (shown in FIG. 17) of the carton 600 (shown in FIG. 17). Similarly, in one embodiment (not shown), at least one of the bottom panels 580 includes an extension extending therefrom for interconnection with a slot within the other bottom panel 580 for facilitating securing the bottom panels 580 together to form a bottom 612 (shown in FIG. 17) of the carton 600 (shown in FIG. 17). Of course, the top panels 576 and the bottom panels 580 may include any suitable interconnection means in addition to, or alternatively to, the extension 584/slot 586 arrangement described above. Accordingly, the top and bottom panels 576 and 580, respectively, are not limited to interconnection using an extension/slot arrangement. For example, in one embodiment, adhesive is applied to portions of the top and bottom panels 576 and 580, respectively. In another embodiment, at least one of the top panels 576 and the bottom panels 580 interconnect using hook and loop fasteners 588.

The side panels 542, 544, 546, and 548 each include an upper panel portion 590, a lower panel portion 592, and an intermediate panel portion 594. The intermediate panel portions 594 each extend from the upper panel portions 590 along a fold line 596 to the lower panel portions 592 along a fold line 598. The side panels 542, 544, 546, and 548 also each includes curved edges 597.

As shown in FIG. 17, a carton 600 can be formed from the blank 540 (shown in FIG. 16) by folding the blank about the various fold lines 550, 552, 554, 562, 570, 574, 578, and 582 (shown in FIG. 16). In one embodiment, an adhesive may be applied to portions of the blank 540 to secure the carton 600 together. Generally, the side panels 542, 544, 546, and 548 (shown in FIG. 16) form four successive sides (generally designated by 602, 604, 606, and 608) of the carton 600, the top panels 576 (shown in FIG. 16) form a top (generally designated by 610) of the carton 600, and the bottom panels 580 (shown in FIG. 16) form a bottom (generally designated by 612) of the carton 600. The carton 600 extends a height 614 measured between the top 610 and the bottom 612 of the carton 600 along a central longitudinal axis 616 extending through the carton 600. As can be seen in FIG. 17, in one embodiment, the carton 600 includes a generally rectangular cross-sectional shape, for example, a cross section taken along the plane 10-10 extending generally perpendicularly to the central longitudinal axis 616. As can also be seen in FIG. 17, each of the sides 602, 604, 606, and 608 extends between the top 610 and the bottom 612 of the carton 600. More specifically, in one embodiment, each of the sides 602, 604, 606, and 608 extends from the top 610 to the bottom 612. Any of the sides 602, 604, 606, and 608 may be referred to herein as a first, a second, a third, and/or a fourth side.

The upper panel portions 590, the lower panel portions 592, and the intermediate panel portions 594 (shown in FIG. 12) form upper portions 618, lower portions 620, and intermediate portions 622, respectively, of each of the sides 602, 604, 606, and 608. A corner 624 is defined at an intersection between the top 610 and each of the sides 602, 604, 606, and 608. Similarly, a corner 626 is defined at an intersection between the bottom 612 and each of the sides 602, 604, 606, and 608. Moreover, a corner 628 is defined at an intersection between each adjacent side of the sides 602, 604, 606, and 608. Additionally, as discussed above, the sides 602, 604, 606, and 608 each include curved edges 597. In one embodiment, the curved edges 597 extend only a portion of the height of the carton 600, although alternatively the curved edges 597 extend from the top 610 to the bottom 612 of the carton 600.

The sides 602, 604, 606, and 608 each form a movable section (generally designated by 630, 632, 634, and 636, respectively) of the carton 600. Any of the movable sections 630, 632, 634, and 636 may be referred to herein as a first, a second, a third, and/or a fourth movable section. The movable sections 630, 632, 634, and 636 are each movable between a first position shown in FIG. 17 (and generally designated by 638) and a second position shown in FIG. 18 (and generally designated by 640). In one embodiment, the movable sections 630, 632, 634, and 636 are movable from the first position 638 to the second position 640 by bending them along the fold lines 596 and 598 (shown in FIG. 16). Accordingly, and as can be seen in FIGS. 17 and 18, movement between the first and second positions 638 and 640, respectively, varies, or changes, a cross-sectional width of the carton 600 defined between the two opposite sides of the sides 604 and 608 along the height of the carton 600. Additionally, because of the curved edges 597, movement from the first position 638 to the second position 640 curves (or increases a curvature of) the sides 602, 604, 606, and/or 608 such that the sides 602, 604, 606, and 608 each include a curved surface. In one embodiment, only a portion of the sides 602, 604, 606, and/or 608 are curved in the second position 640 as shown in FIG. 18. Alternatively, in another embodiment the sides 602, 604, 606, and/or 608 are curved from the top 610 to the bottom 612 of the container 600.

In one embodiment, a cross-sectional width defined between two opposite sides of the sides 602, 604, 606, and 608 and generally adjacent the movable sections 630, 632, 634, and 636 (e.g., a cross section taken alone plane 11-11 in FIG. 17) is generally greater in the first position 638 than in the second position 640. In one embodiment, at least one of the movable sections 630, 632, 634, and 636 is biased in the first position 638. Although the movable sections 630, 632, 634, and 636 may be biased in the first position 638 using any suitable mechanism, in one embodiment, a structure of the carton 600 biases the movable sections 630, 632, 634, and 636.

Once the carton 600 has been formed, and either before, simultaneously with, or after a product is placed within the carton 600, a heat-shrinkable layer (generally designated by 642) can be wrapped around at least a portion of the carton 600 and heat-shrunk to form a package assembly, one embodiment of which is shown in FIG. 18 and generally designated by 644. Specifically, in the embodiment shown in FIG. 18 the heat-shrinkable layer 642 is wrapped around the sides 602, 604, 606, and 608, a portion of which extends beyond the top 610 and another portion of which extends beyond the bottom 612. The layer 642 is then heated to shrink the heat-shrinkable layer into contact with the carton 600. The layer 642 shrinks to fit snuggly around the carton 600. Although the heat-shrinkable layer 642 can overlap any portion of the carton 600, in the embodiment shown in FIG. 18 the heat-shrunk layer 642 substantially overlaps the sides 602, 604, 606, and 608 and the corners 624, 626, and 628, and overlaps a portion of the top 610 and at least a portion of the bottom 612. FIG. 19 illustrates an alternative embodiment of the package assembly 644 wherein the layer 642 does not overlap any portion of the top 610 or the bottom 612 of the carton 600. Although other types of heat-shrinkable layers may be used, in one embodiment the heat-shrinkable layer 642 is a sheet of material or a sleeve of material. Additionally, although other materials may be used for the layer 642, in one embodiment the layer 642 includes polyethylene, polypropylene, polyvinyl chloride, polyester glycol, nylon, and/or oriented polystyrene.

The heat-shrunk layer 642 may facilitate sealing the carton 600 to protect a product contained within the carton from tampering and to generally seal the corners/joints of the carton 600 for containing the product within the carton 600 as well as protecting the product from contamination. The heat-shrunk layer 642 can be used, for example, to replace bags or liners sometimes used within a container for sealing a product. The tight fit of the heat-shrunk layer 642 may also facilitate maintaining a shape of the carton 600 for example, to facilitate displaying, stacking and/or arranging the carton 600 or a plurality thereof of cartons, and/or maintaining a shape that facilitates other functionality such as carrying the carton.

In one embodiment, the top 610 (and/or one or more of the sides 602, 604, 606, and 608) includes a handle 646 extending outwardly therefrom for carrying the assembly. The heat-shrunk layer 642 includes an opening 648 therein adjacent the handle 646 such that the handle 646 extends through the opening 648 allowing access to the handle when the heat-shrunk layer 642 overlaps a portion of the carton 600.

In one embodiment, the carton 600 and/or the layer 642 includes a marking thereon, such as, but not limited to, indicia that communicates the product, a manufacturer of the product, and/or a seller of the product. For example, printed text that indicates a product's name and briefly describes the product, logos and trademarks that indicate a manufacturer and/or seller of the product, and/or designs and/or ornamentation that attracts attention.

The heat-shrinkable layer 642 may also facilitate forming of the carton, and more specifically moving the moveable sections 630, 632, 634, and 636 from the first position 638 to the second position 640 to form the package assembly 644. As described above, cartons having shapes that are more complex than conventional rectangular cartons may be difficult and therefore costly to manufacture.

However, in one embodiment the heat-shrinkable layer 642 is wrapped around the carton 600 such that the heat-shrinkable layer 642 overlaps at least a portion of one or more of the movable sections 630, 632, 634, and 636. As the layer 642 is heated and shrinks into contact with the movable sections 630, 632, 634, and 636, the layer moves the movable sections 630, 632, 634, and 636 from the first position 638 (shown in FIG. 17) to the second position 640 to form a shape of the package assembly 644. The heat-shrunk layer 642 then holds the movable sections 630, 632, 634, and 636 in the second position 640 as long as the layer 642 remains substantially wrapped around the carton 600. In one embodiment wherein the movable sections 630, 632, 634, and 636 are biased to the first position, the layer 642 moves the movable sections to, and holds the movable section in, the second position 640 against the bias. By moving and holding the movable sections 630, 632, 634, and 636 into the second position 640, the layer 642 facilitates forming a shape of the package assembly 644, and more specifically the carton 600, that may be otherwise difficult and costly to form.

Figure 20:
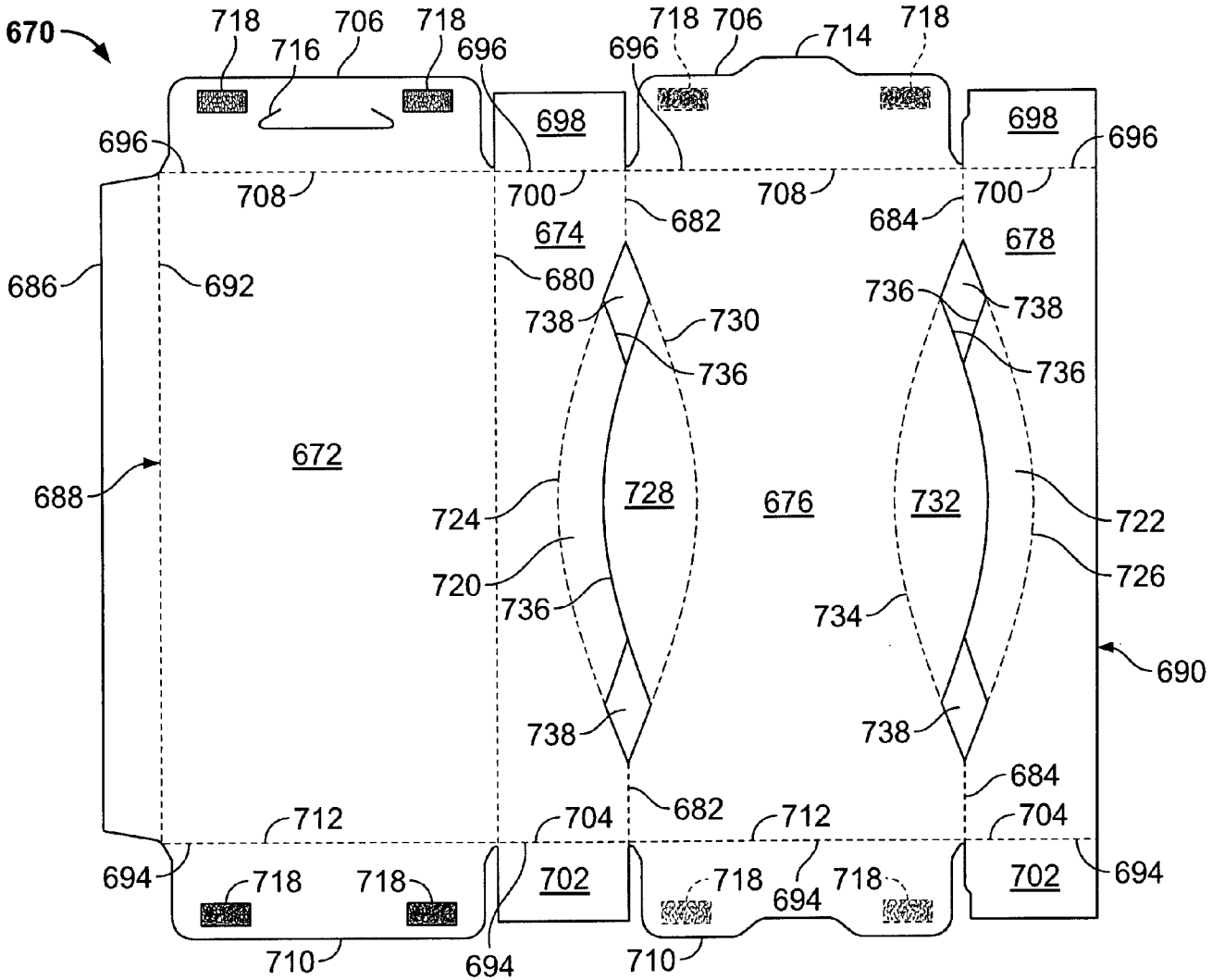
FIG. 20 is a top plan view of an exemplary embodiment of a blank of sheet material for forming another exemplary carton.
Figure 21:
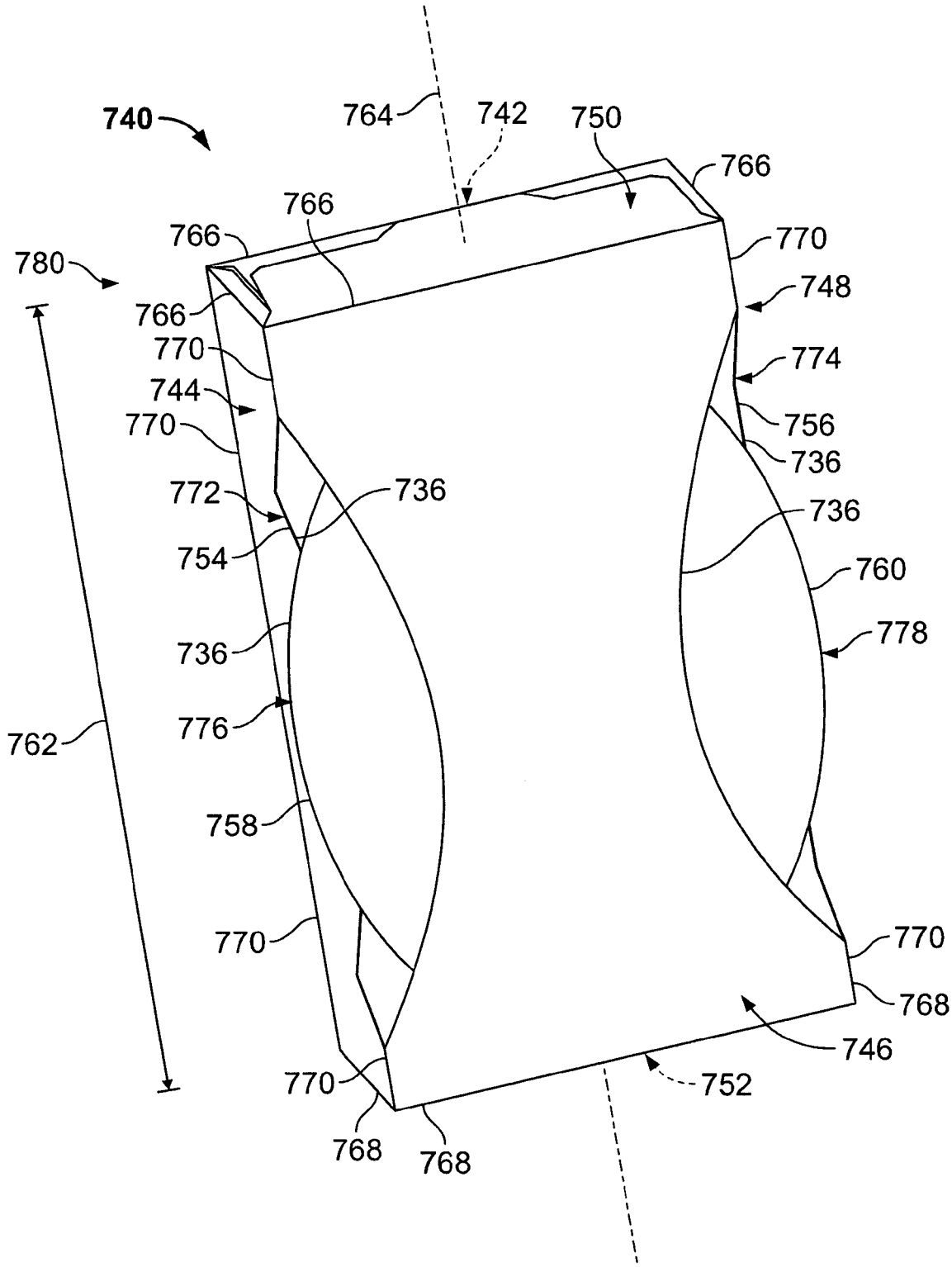
FIG. 21 is a perspective view of an exemplary embodiment of a carton formed from the blank shown in FIG. 20.
Figure 22:
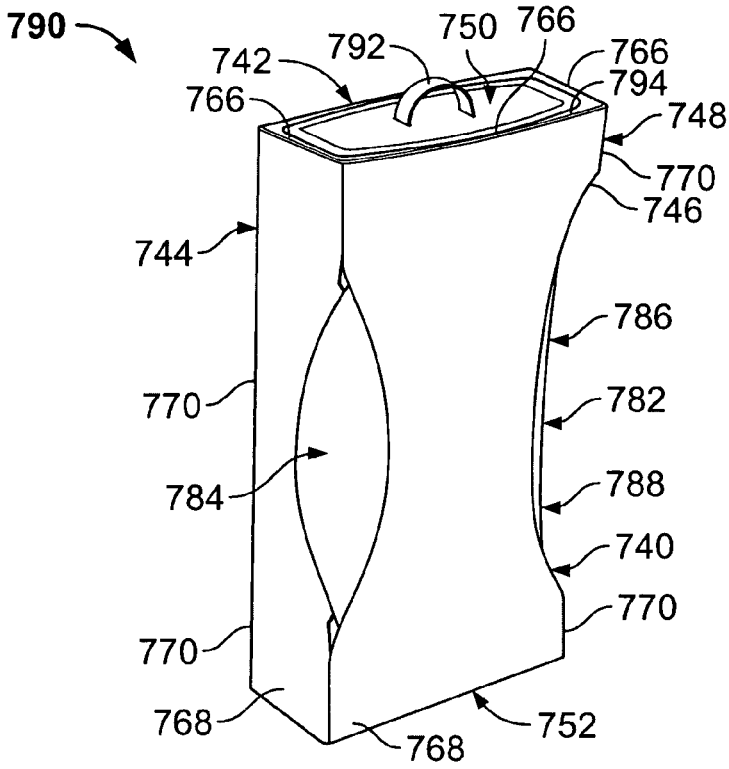
FIG. 22 is a perspective view of an exemplary embodiment of a packaging assembly including the carton shown in FIG. 21.
Figure 23:
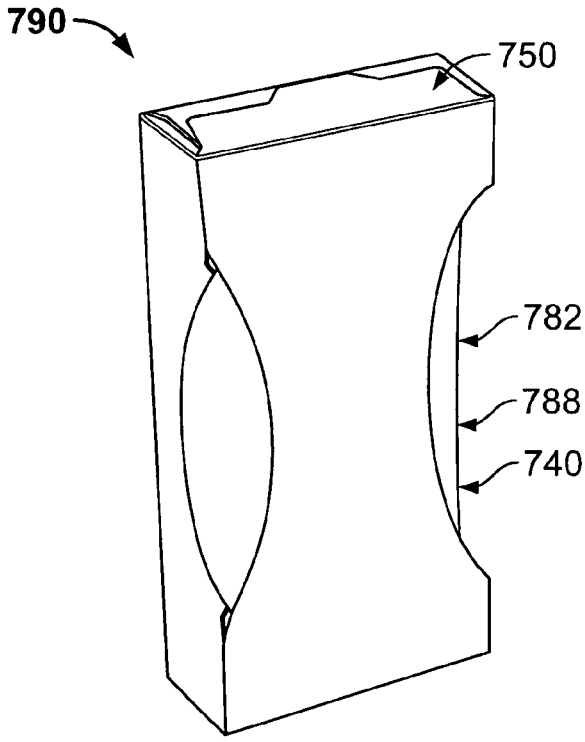
FIG. 23 is a perspective view of an alternative embodiment of the packaging assembly shown in FIG. 22.

Although as described above a package assembly may have any suitable size, shape, and/or configuration (e.g., number of sides), FIGS. 20-23 illustrate the formation of one embodiment of a package assembly. Specifically, FIG. 20 is a top plan view of one embodiment of a blank of sheet material (designated in its entirety by the reference numeral 670). FIG. 21 is a perspective view of one embodiment of a carton (designated in its entirety by 740) formed from the blank 670 shown in FIG. 20. FIG. 22 is a perspective view of one embodiment of a packaging assembly (designated in its entirety by 790) including the carton 740 shown in FIG. 21. FIG. 23 is a perspective view of an alternative embodiment of the packaging assembly 790 shown in FIG. 22.

Referring to FIG. 20, the blank 670 includes a succession of four side panels 672, 674, 676, and 678 that are connected together by a plurality of preformed, generally parallel, fold lines 680, 682, and 684, respectively. Specifically, each of the side panels 672, 674, 676, and 678 extends from an adjacent one of the side panels along the respective fold lines 680, 682, and 684. A side panel flap 686 extends from an end portion (generally designated by 688) of the side panel 672, or alternatively from an end portion (generally designated by 690) of the side panel 678, along a fold line 692 for facilitating securing the end portions 688 and 690 together to form the carton 740 (shown in FIG. 21). Each of the side panels 672, 674, 676, and 678 extends a height measured between a bottom end 694 and a top end 696.

The side panel 674 and the side panel 678 each include a top support panel 698 extending from the top end 696 thereof along a fold line 700 and a bottom support panel 702 extending from the bottom end 694 thereof along a fold line 704. Additionally, the side panel 672 and the side panel 676 each include a top panel 706 extending from the top end 696 thereof along a fold line 708 and a bottom panel 710 extending from the bottom end 694 thereof along a fold line 712. In one embodiment, at least one of the top panels 706 includes an extension 714 extending therefrom for interconnection with a slot 716 within the other top panel 706 for facilitating securing the top panels 706 together to form a top 750 (shown in FIG. 21) of the carton 740 (shown in FIG. 21). Similarly, in one embodiment (not shown), at least one of the bottom panels 710 includes an extension extending therefrom for interconnection with a slot within the other bottom panel 710 for facilitating securing the bottom panels 710 together to form a bottom 752 (shown in FIG. 21) of the carton 740 (shown in FIG. 21). Of course, the top panels 706 and the bottom panels 710 may include any suitable interconnection means in addition to, or alternatively to, the extension 714/slot 716 arrangement described above. Accordingly, the top and bottom panels 706 and 710, respectively, are not limited to interconnection using an extension/slot arrangement. For example, in one embodiment, adhesive is applied to portions of the top and bottom panels 706 and 710, respectively. In another embodiment, at least one of the top panels 706 and the bottom panels 710 interconnect using hook and loop fasteners 718.

The side panels 674 and 678 each include an extension panel 720 and 722, respectively, extending therefrom along a fold line 724, 726, respectively. The side panel 676 also includes an extension panel 728 extending therefrom along a fold line 730 and an opposite extension panel 732 extending along a fold line 734. In one embodiment, the fold lines 724, 726, 730, and/or 734 are curved. Moreover, in one embodiment the extension panels 720, 722, 728, and/or 732 includes a curved edge 736. Any of the extension panels 720, 722, 728, and/or 732 may be referred to herein as a first, second, third, and/or fourth extension. Additionally, as can be seen in FIG. 20, a plurality of openings 738 are formed between adjacent panels of the extension panels 720, 722, 728, and 732.

As shown in FIG. 21, a carton 740 can be formed from the blank 670 (shown in FIG. 20) by folding the blank about the various fold lines 680, 682, 684, 692, 700, 704, 708, and 712 (shown in FIG. 20). In one embodiment, an adhesive may be applied to portions of the blank 670 to secure the carton 740 together. Generally, the side panels 672, 674, 676, and 678 (shown in FIG. 20) form four successive sides (generally designated by 742, 744, 746, and 748) of the carton 740, the top panels 706 (shown in FIG. 20) form a top (generally designated by 750) of the carton 740, and the bottom panels 710 (shown in FIG. 20) form a bottom (generally designated by 752) of the carton 740. The extension panels 720, 722, 728, and 732 each form a respective extension 754, 756, 758, and 760. The carton 740 extends a height 762 measured between the top 750 and the bottom 752 of the carton 740 along a central longitudinal axis 764 extending through the carton 740. As can also be seen in FIG. 21, each of the sides 742, 744, 746, and 748 extends between the top 750 and the bottom 752 of the carton 740. More specifically, in one embodiment, each of the sides 742, 744, 746, and 748 extends from the top 750 to the bottom 752. Any of the sides 742, 744, 746, and 748 may be referred to herein as a first, a second, a third, and/or a fourth side.

A corner 766 is defined at an intersection between the top 750 and each of the sides 742, 744, 746, and 748. Similarly, a corner 768 is defined at an intersection between the bottom 752 and each of the sides 742, 744, 746, and 748. Moreover, a corner 770 is defined at an intersection between each adjacent side of the sides 742, 744, 746, and 748. Additionally, as discussed above, the extensions 754, 756, 758, and 760 each include curved edges 736.

The extensions 754, 756, 758, and 760 each form a movable section (generally designated by 772, 774, 776, and 778, respectively) of the carton 740. Any of the movable sections 772, 774, 776, and 778 may be referred to herein as a first, a second, a third, and/or a fourth movable section. The movable sections 772, 774, 776, and 778 are each movable between a first position shown in FIG. 21 (and generally designated by 780) and a second position shown in FIG. 22 (and generally designated by 782). In one embodiment, the movable sections 772, 774, 776, and 778 are movable from the first position 780 to the second position 782 by bending them along the fold lines the corresponding fold lines 724, 726, 730, and 734 (shown in FIG. 20). Accordingly, and as can be seen in FIGS. 21 and 22, movement between the first and second positions 780 and 782, respectively, creates a side (generally designated by 784) defined between the side 744 and the side 746 and a side (generally designated by 786) defined between the side 746 and the side 748. In one embodiment, the side 784 is obliquely angled with respect to the side 744 and the side 786 is obliquely angled with respect to the side 746. Any of the sides 742, 744, 746, 748, 784, and 786 may be referred to herein as a first, a second, a third, a fourth, a fifth, and/or a sixth side. In one embodiment, the sides 784 and/or 786 extend only partially between the top 750 and the bottom 752 of the carton 740. Alternatively, the sides 784 and/or 786 extend from the top 750 to the bottom 752 of the carton 740.

Specifically, the movable section 772 (extension 754) is bended along the fold line 724 towards an interior of the carton 780 such that the section 772 is obliquely angled with respect to the side 744. Similarly, the movable section 776 (extension 758) is bended along the fold line 730 towards an interior of the cart 780 such that the section 776 is obliquely angled with respect to the side 746 and such that the section 776 at least partially overlaps the section 772. The movable section 774 (extension 756) is also bended along the fold line 726 towards an interior of the carton 780 such that the section 774 is obliquely angled with respect to the side 748. Similarly, the movable section 778 (extension 760) is bended along the fold line 734 towards an interior of the cart 780 such that the section 778 is obliquely angled with respect to the side 746 and such that the section 778 at least partially overlaps the section 774. As can be seen in FIG. 22, in one embodiment movement from the first position 780 to the second position 782 at least partially closes the openings 738 (shown in FIG. 20). Additionally, because of the curved edges 736, movement from the first position 780 to the second position 782 curves (or increases a curvature of) the side 746 such that the side 746 includes a curved surface. In one embodiment, only a portion of the side 746 is curved in the second position 782 as shown in FIG. 22. Alternatively, in another embodiment the side 746 is curved from the top 750 to the bottom 752 of the container 740. In one embodiment, at least one of the movable sections 772, 774, 776, and 778 is biased in the first position 780. Although the movable sections 772, 774, 776, and 778 may be biased in the first position 780 using any suitable mechanism, in one embodiment, a structure of the carton 740 biases the movable sections 772, 774, 776, and 778.

Once the carton 740 has been formed, and either before, simultaneously with, or after a product is placed within the carton 740, a heat-shrinkable layer (generally designated by 788) can be wrapped around at least a portion of the carton 740 and heat-shrunk to form a package assembly, one embodiment of which is shown in FIG. 22 and generally designated by 790. Specifically, in the embodiment shown in FIG. 22 the heat-shrinkable layer 788 is wrapped around the sides 742, 744, 746, 748, 784, and 786, a portion of which extends beyond the top 750 and another portion of which extends beyond the bottom 752. The layer 788 is then heated to shrink the heat-shrinkable layer into contact with the carton 740. The layer 788 shrinks to fit snuggly around the carton 740. Although the heat-shrinkable layer 788 can overlap any portion of the carton 740, in the embodiment shown in FIG. 22 the heat-shrunk layer 788 substantially overlaps the sides 742, 744, 746, 748, 784, and 786 and the corners 766, 768, and 770, and overlaps a portion of the top 750 and at least a portion of the bottom 752. FIG. 23 illustrates an alternative embodiment of the package assembly 790 wherein the layer 788 does not overlap any portion of the top 750 or the bottom 752 of the carton 740. Although other types of heat-shrinkable layers may be used, in one embodiment the heat-shrinkable layer 788 is a sheet of material or a sleeve of material. Additionally, although other materials may be used for the layer 788, in one embodiment the layer 788 includes polyethylene, polypropylene, polyvinyl chloride, polyester glycol, nylon, and/or oriented polystyrene.

The heat-shrunk layer 788 may facilitate sealing the carton 740 to protect a product contained within the carton from tampering and to generally seal the corners/joints of the carton 740 for containing the product within the carton 740 as well as protecting the product from contamination. The heat-shrunk layer 788 can be used, for example, to replace bags or liners sometimes used within a container for sealing a product. The tight fit of the heat-shrunk layer 788 may also facilitate maintaining a shape of the carton 740 for example, to facilitate displaying, stacking and/or arranging the carton 740 or a plurality thereof of cartons, and/or maintaining a shape that facilitates other functionality such as carrying the carton.

In one embodiment, the top 750 (and/or one or more of the sides 742, 744, 746, and 748) includes a handle 792 extending outwardly therefrom for carrying the assembly. The heat-shrunk layer 788 includes an opening 794 therein adjacent the handle 792 such that the handle 792 extends through the opening 794 allowing access to the handle when the heat-shrunk layer 788 overlaps a portion of the carton 740.

In one embodiment, the carton 740 and/or the layer 788 includes a marking thereon, such as, but not limited to, indicia that communicates the product, a manufacturer of the product, and/or a seller of the product. For example, printed text that indicates a product's name and briefly describes the product, logos and trademarks that indicate a manufacturer and/or seller of the product, and/or designs and/or ornamentation that attracts attention.

The heat-shrinkable layer 788 may also facilitate forming of the carton, and more specifically moving the moveable sections 772, 774, 776, and 778 from the first position 780 to the second position 782 to form the package assembly 790. As described above, cartons having shapes that are more complex than conventional rectangular cartons may be difficult and therefore costly to manufacture.

However, in one embodiment the heat-shrinkable layer 788 is wrapped around the carton 740 such that the heat-shrinkable layer 788 overlaps at least a portion of one or more of the movable sections 772, 774, 776, and 778. As the layer 788 is heated and shrinks into contact with the movable sections 772, 774, 776, and 778, the layer moves the movable sections 772, 774, 776, and 778 from the first position 780 (shown in FIG. 21) to the second position 782 to form a shape of the package assembly 790. The heat-shrunk layer 788 then holds the movable sections 772, 774, 776, and 778 in the second position 782 as long as the layer 788 remains substantially wrapped around the carton 740. In one embodiment wherein the movable sections 772, 774, 776, and 778 are biased to the first position, the layer 788 moves the movable sections to, and holds the movable section in, the second position 782 against the bias. By moving and holding the movable sections 772, 774, 776, and 778 into the second position 782, the layer 788 facilitates forming a shape of the package assembly 790, and more specifically the carton 740, that may be otherwise difficult and costly to form.

In one embodiment, the carton 854 and/or the layer 880 includes a marking thereon, such as, but not limited to, indicia that communicates the product, a manufacturer of the product, and/or a seller of the product. For example, printed text that indicates a product's name and briefly describes the product, logos and trademarks that indicate a manufacturer and/or seller of the product, and/or designs and/or ornamentation that attracts attention.

Figure 24:
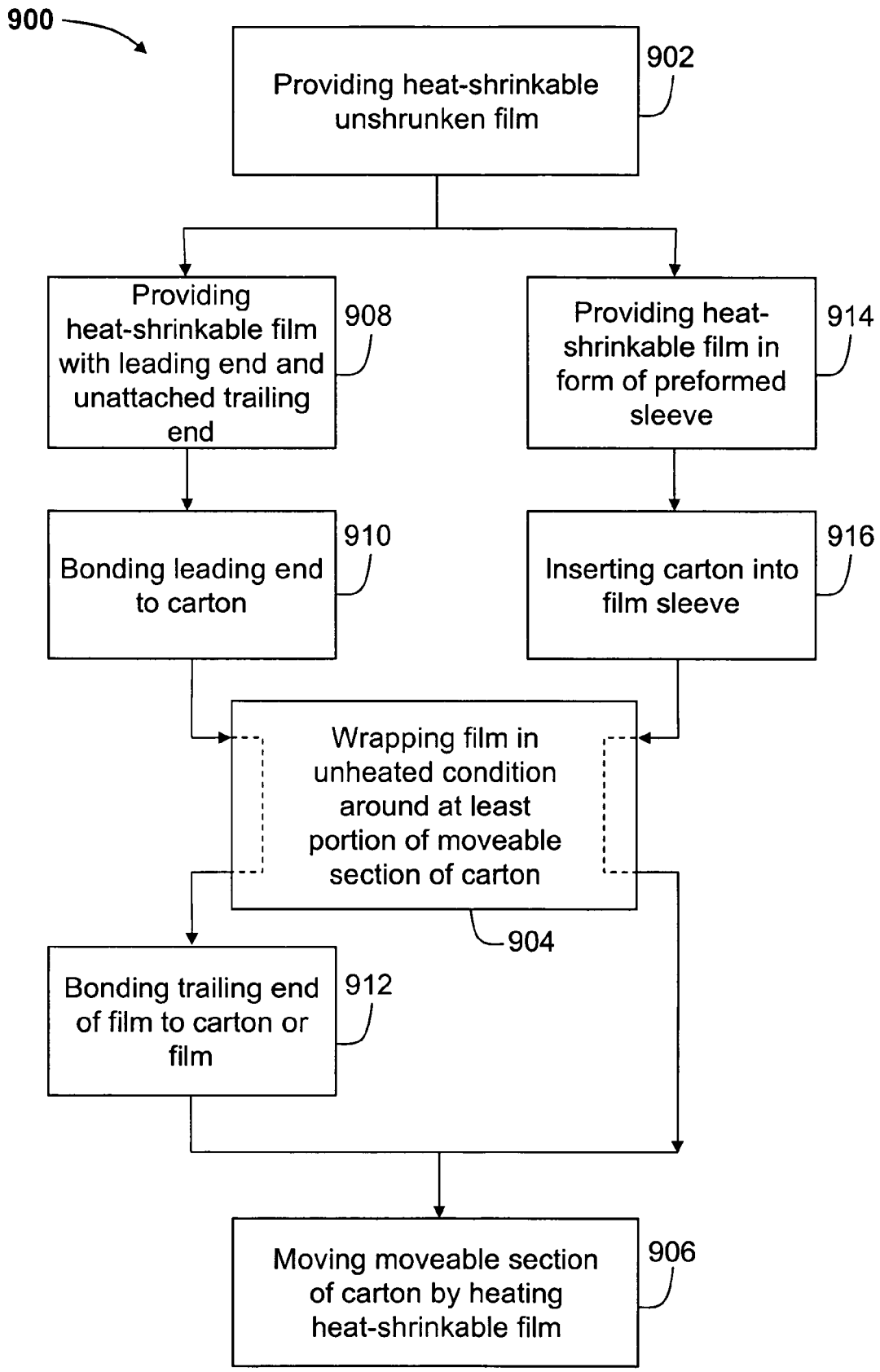
FIG. 24 is a flowchart illustrating exemplary processes for applying a heat-shrinkable film to an exemplary carton for forming a shape of the carton.

FIG. 24 is a flowchart 900 illustrating exemplary processes for applying a heat-shrinkable film to an exemplary carton for forming a shape of the carton. In the example embodiment, process 900 may be applied to any of the cartons described above or any other carton that includes a top panel, a bottom panel, at least one side panel extending between the top panel and the bottom panel, and a movable section that is movable between a first position and a second position. Process 900 includes the steps of providing 902 a heat-shrinkable but unshrunken film, wrapping 904 the film in an unheated condition around at least a portion of the carton including at least a portion of the movable section of the carton, and moving 906 the movable section from the first position to the second position to form a shape of the carton by heating the heat-shrinkable film to shrink the heat-shrinkable film into contact with at least a portion of the movable section.

In one embodiment, step 902 further includes providing 908 a heat-shrinkable but unshrunken film that has a leading end and a trailing end that is unattached to the leading end, bonding 910 the leading end of the film to the carton, wrapping 904 the film in an unheated condition around at least a portion of the carton including at least a portion of the movable section of the carton, and bonding 912 the trailing end of the film to at least one of the carton and the film itself. The carton may include at least one seam wherein the at least one seam is formed when at least two panels of the carton are adhered to one another. In such a case, the bonding of the leading end of the film to the carton may include bonding the leading end of the film within a seam of the carton such that the leading end is not visible.

In another embodiment, step 902 further includes providing 914 a heat-shrinkable but unshrunken film in the form of a pre-formed sleeve wherein the sleeve has an opening sized to receive the carton, and inserting 916 the carton into the sleeve opening. In this example embodiment, the film sleeve may be bonded to the carton prior to shrinking using an adhesive or may be coupled to the carton using a friction fit. In another embodiment, the film is bonded using heat, sonic welding or other method of bonding such material.

In one embodiment, the heat-shrinkable film includes a marking thereon. The marking may include graphics for the carton or graphics to coordinate with additional graphics printed on the carton. In one embodiment, the markings are applied using an opaque ink. Alternatively, the markings may be applied using a translucent ink such that the markings coordinate with the additional graphics printed on the carton.

The heat-shrinkable film is manufactured from one of polyethylene, polypropylene, polyvinyl chloride, polyester, polyester glycol, nylon, and/or oriented polystyrene. In one embodiment, the film extends a height greater than the height of the carton. The film having a greater height than the carton is wrapped around the carton such that at least a portion of the moveable section of the carton is wrapped with the film. The film is wrapped in an unheated condition such that the film extends a distance outwardly from at least one of the top and bottom of the carton. After wrapping, the film is then heated to shrink the film into contact with at least a portion of the top and/or bottom of the carton to provide a tamper-resistant measure, a moisture barrier and/or a sifting barrier.

In an alternative embodiment, the heat-shrinkable film extends a height less than the height of the carton. In other words, the heat-shrinkable film is a band that is wrapped around at least a portion of the carton. The film is wrapped in an unheated condition around a portion of the carton such that at least a portion of the moveable section of the carton becomes wrapped.

In one embodiment, the moveable section of the carton is moved by using a plurality of heat-shrinkable film types each having different shrink orientations and percentages. The heat-shrinkable films are heated to come in contact with at least a portion of the moveable section. Upon heating the different types of films, each film shrinks to a different degree allowing the films to form a shape of the carton.

In another embodiment, the movable section of the carton is moved by applying one type of heat-shrinkable film and heating the film at different temperatures to control the degree of film shrinkage. As such, the film forms the shape of the carton.

It is further possible to control the degree of film shrinkage by combining any of the hereinabove described methods. As such, the degree of film shrinkage can be controlled by any combination of using a specific film type, controlling the temperature of heating and/or targeting the heat applied to the film. Any of these methods or combination of methods will facilitate moving the movable section of the carton from a first position to a second position to form a shape of the carton. This shape may further include a cut-out in the carton to allow visibility of the product within the carton. In other words, the moveable section may include a cut-out in the carton which allows for the movement of the carton. By applying and heating the different heat-shrinkable films, the moveable section can be moved wherein the cut-out is closed by the panels of the carton or the cut-out can be left such that the product included within the carton is visible to a consumer.

Creating the moveable section of the carton can be achieved in several ways. In one embodiment, the cross-sectional area of the carton may be changed when the moveable section is moved from the first position to the second position. Alternatively, the carton may include overlapping first and second moveable sections.

In the example embodiment and depending upon the product type and configuration, the carton may be erected and shrink-formed while empty (i.e., prior to the insertion of the desired product), or the carton may be erected, product loaded, carton sealed, and then the entire loaded package subjected to a controlled heat source which will shrink-form the carton to its finished shape.

The process described hereinabove is performed by a system or machine configured to carry out the steps of FIG. 24. In one embodiment, the system includes a carton having a top panel, a bottom panel, at least one side panel, and a moveable section configured to move from a first position to a second position. The system further includes a wrapping device configured to wrap the carton with unshrunken heat-shrinkable film in an unheated condition. The film is wrapped around at least a portion of the carton and at least a portion of the moveable section of the carton. The system also includes a heating device configured to heat at least a portion of the heat-shrinkable film. Upon heating, the film moves into contact with at least a portion of the moveable section of the carton to move the moveable section from a first position to a second position.

In one embodiment, the heat-shrinkable film includes a leading end and a trailing end. The wrapping device bonds the leading end of the film to the carton and wraps the film around at least a portion of the carton, including a portion of the moveable section. The wrapping device then bonds the trailing end to either the carton or the film itself. The bonding can be performed using an adhesive, heat, sonic welding or other method or material for bonding such materials. In one embodiment, the carton may include at least one seam formed when at least two panels are adhered together. The system is configured to bond the leading end of the film to the seam of the carton such that the leading end is not visible.

In an alternative embodiment, the heat-shrinkable film is pre-formed as a sleeve having an opening to receive the carton. The wrapping device inserts the carton into the sleeve while the film is in an unheated, unshrunken condition.

In one embodiment, the heat-shrinkable film is a sheet, patch or sleeve of shrinkable material that includes polyethylene, polypropylene, polyvinyl chloride, polyester, polyester glycol, nylon and/or oriented polystyrene. In an alternative embodiment, any suitable shrinkable material known to those skilled in the art and guided by the teachings herein provided is used to fabricate the heat-shrinkable film. Further, in one embodiment, the heat-shrink film is transparent. The heat-shrinkable film is movable from an initial, first or pre-shrunk configuration to a second or shrunk configuration having a shorter width and/or shorter length than in the pre-shrunk configuration. For example, the heat-shrink film is shrinkable to move from the pre-shrunk configuration to the shrunk configuration to move or urge the moveable section of the carton to the second position. As the heat-shrinkable film shrinks, such as by applying suitable heat, voids within the moveable section at least partially closes to move or urge the movable section together.

In one embodiment, the heat-shrinkable film includes at least one layer of a flexible, heat-shrinkable plastic film having an activated shrink temperature of at least about 140° F., and suitably about 150° F. to about 195° F. The film has a gauge thickness of about 50 gauge to about 150 gauge. In one embodiment, the film is formulated with a balanced shrink ratio, or balanced orientation, such that the film shrinks an equal amount in a machine direction or orientation of the film and a cross-machine or transverse direction or orientation of the film. The balanced shrink ratio facilitates a uniform and consistent shrink profile and will not distort printed indicia and/or decorative patterns printed on the film upon the application of heat. Further, the film has a shrink factor of about 10% to about 50% such that the film will shrink in the machine direction and the transverse direction by about 10% to about 50%. In alternative embodiments, the film is formulated with an unbalanced shrink ratio such that the film shrinks to a greater degree in one of the machine direction and the transverse direction. In a particular alternative embodiment, the film has a shrink factor in the machine direction different than a shrink factor in the transverse direction such that the film will shrink in opposite directions by a different percentage of an initial length. In another alternative embodiment, the heat-shrinkable film includes a stretched film coupled to an interior surface in a stretched configuration.

In the example embodiment, by using controlled and specifically directed heat, time and temperature applications, specific areas of the carton including specific panels of the carton may be affected to achieve lesser or higher degrees of shaping.

In another embodiment, the carton includes a heat-shrinkable film as described above in combination with a shrink-film lamination or other lamination applied to the carton. The heat-shrinkable film in combination with the lamination provides an additional barrier protection for the carton.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

While the invention has been described in terms of various specific embodiments, those skilled in the art will recognize that the invention can be practiced with modification within the spirit and scope of the claims.

What is claimed is:

1. A method for applying a heat shrinkable film to a carton for forming a shape of the carton, the carton including a top panel, a bottom panel, a plurality of side panels extending between the top panel and the bottom panel, and a movable section that is movable between a first position and a second position, said method comprising:

providing a heat-shrinkable but unshrunken film;

wrapping the film in an unheated condition around at least a portion of the carton including at least a portion of the movable section of the carton, wherein the movable section including at least one opening having a size and at least one movable panel, wherein the at least one opening is a cut-out defined within at least one of the plurality of side panels; and moving the movable section from the first position to the second position to form a shape of the carton by heating the heat-shrinkable film to shrink the heat-shrinkable film into contact with at least a portion of the movable section, wherein moving the movable section includes moving the at least one movable panel and reducing the size of the at least one opening of the movable section.

2. A method in accordance with claim 1 wherein providing a heat-shrinkable but unshrunken film further comprises:

providing a heat-shrinkable but unshrunken film having a leading end and a trailing end unattached to the leading end;

bonding the leading end of the film to the carton;

wrapping the film in an unheated condition around at least a portion of the carton including at least a portion of the movable section of the carton; and bonding the trailing end of the film to at least one of the carton and the film itself.

3. A method in accordance with claim 2 wherein the carton further includes at least one seam wherein the at least one seam is formed when at least two panels are adhered to one another, and wherein bonding the leading end of the film to the carton further comprises bonding the leading end of the film within a seam of the carton such that the leading end is not visible.

4. A method in accordance with claim 1 wherein providing a heat-shrinkable but unshrunken film further comprises providing a heat-shrinkable but unshrunken film in the form of a pre-formed sleeve, the sleeve having an opening sized to receive the carton.

5. A method in accordance with claim 4 wherein providing a heat-shrinkable but unshrunken film in the form of a pre-formed sleeve further comprises:

inserting the carton into the sleeve opening; and moving the movable section from the first position to the second position to form a shape of the carton by heating the heat-shrinkable sleeve to shrink the heat-shrinkable sleeve into contact with at least a portion of the movable section.

6. A method in accordance with claim 1 wherein providing a heat-shrinkable but unshrunken film further comprises providing a heat-shrinkable but unshrunken film that includes a marking thereon.

7. A method in accordance with claim 1 wherein providing a heat-shrinkable but unshrunken film further comprises providing a heat-shrinkable but unshrunken film having a marking thereon including graphics for the carton, wherein the graphics are applied using an opaque ink.

8. A method in accordance with claim 1 wherein providing a heat-shrinkable but unshrunken film further comprises providing a heat-shrinkable but unshrunken film having a marking thereon including graphics for the carton, wherein the graphics are applied using a translucent ink such that the film graphics coordinate with additional graphics printed on the carton.

9. A method in accordance with claim 1 wherein providing a heat-shrinkable but unshrunken film further comprises providing a heat-shrinkable but unshrunken film manufactured from at least one of polyethylene, polypropylene, polyvinyl chloride, polyester, polyester glycol, nylon, and/or oriented polystyrene.

10. A method in accordance with claim 1 wherein the carton extends a height measured between the top and the bottom of the carton, and the film extends a height greater than the carton height, and wherein wrapping the film further comprises:

wrapping the film in an unheated condition around the carton including the movable section of the carton wherein the film extends a distance outwardly from at least one of the top and the bottom of the carton; and heating the heat-shrinkable film to shrink the heat-shrinkable film into contact with at least a portion of the at least one of the top and the bottom of the carton for providing at least one of a tamper resistance measure, a moisture barrier, and a sifting barrier.

11. A method in accordance with claim 1 wherein the carton extends a height measured between the top and the bottom of the carton, and the film extends a height less than the carton height, and wherein wrapping the film further comprises wrapping the film in an unheated condition around a portion of the carton including at least a portion of the movable section of the carton.

12. A method in accordance with claim 1 wherein moving the movable section further comprises:

providing a plurality of heat-shrinkable film types including heat-shrinkable films having different shrink orientations and percentages; and moving the movable section from the first position to the second position using the plurality of the heat-shrinkable film types to form a shape of the carton by heating the heat-shrinkable film to shrink the heat-shrinkable film into contact with at least a portion of the movable section.

13. A method in accordance with claim 1 wherein moving the movable section further comprises applying a plurality of different heating temperatures to at least a portion of the heat-shrinkable film for controlling a degree of shrinkage of the film.

14. A method in accordance with claim 1 further comprising:

controlling a degree of shrinkage of the film by at least one of using a specific type of film, controlling a temperature of the heating, and targeting the heating on the film; and moving the movable section from the first position to the second position to form a shape that includes at least one cut-out in the carton such that a product included within the carton is visible.

15. A method in accordance with claim 1 wherein said moving the movable section further comprises changing a cross sectional area of at least a portion of the carton.

16. A method in accordance with claim 1 wherein the movable section comprises a first movable section and a second movable section, and said moving the movable section further comprises overlapping the second movable section with the first movable section.

17. A system for applying a heat shrinkable film to a carton for forming a shape of the carton, said system comprising:

a carton comprising a top panel, a bottom panel, a plurality of side panels extending between the top panel and the bottom panel, and a movable section that is movable between a first position and a second position;

a wrapping device configured to wrap a heat-shrinkable but unshrunken film in an unheated condition around at least a portion of the carton including at least a portion of the movable section of the carton, wherein the movable section including at least one opening having a size and at least one movable panel wherein the at least one opening is a cut-out defined within at least one of the plurality of side panels; and a heating device configured to heat at least a portion of the heat-shrinkable film into contact with at least a portion of the movable section to move the movable section from the first position to the second position to form a shape of the carton, wherein moving the movable section includes moving the at least one movable panel and reducing the size of the at least one opening of the movable section.

18. A system in accordance with claim 17 wherein the heat-shrinkable but unshrunken film includes a leading end and a trailing end unattached to the leading end, and wherein the wrapping device is further configured to:

bond the leading end of the film to the carton;

wrap the film in an unheated condition around at least a portion of the carton including at least a portion of the movable section of the carton; and bond the trailing end of the film to at least one of the carton and the film itself.

19. A system in accordance with claim 18 wherein the carton further includes at least one seam wherein the at least one seam is formed when at least two panels are adhered to one another, and wherein the wrapping device is further configured to bond the leading end of the film within a seam of the carton such that the leading end is not visible.

20. A system in accordance with claim 17 wherein the wrapping device is further configured to insert the carton into a heat-shrinkable but unshrunken film in the form of a preformed sleeve, the sleeve having an opening sized to receive the carton.

* * * * *